US009423116B2

(12) United States Patent
Sieberth et al.

(10) Patent No.: US 9,423,116 B2
(45) Date of Patent: Aug. 23, 2016

(54) LED LAMP AND MODULAR LIGHTING SYSTEM

(71) Applicant: Cree, Inc., Durham, NC (US)

(72) Inventors: Bernd R. Sieberth, Salem, WI (US); Steven J. Patkus, Mount Pleasant, WI (US)

(73) Assignee: Cree, Inc., Durham, NC (US)

( * ) Notice: Subject to any disclaimer, the term of this patent is extended or adjusted under 35 U.S.C. 154(b) by 219 days.

(21) Appl. No.: 14/103,063

(22) Filed: Dec. 11, 2013

(65) Prior Publication Data

US 2015/0159848 A1 Jun. 11, 2015

(51) Int. Cl.

| | |
|---|---|
| ***F21V 23/06*** | (2006.01) |
| ***F21S 2/00*** | (2016.01) |
| ***F21V 21/005*** | (2006.01) |
| *F21Y 101/02* | (2006.01) |

(52) U.S. Cl.

CPC ..... *F21V 23/06* (2013.01); *F21S 2/005* (2013.01); *F21S 4/28* (2016.01); *F21V 21/005* (2013.01); *F21Y 2101/02* (2013.01)

(58) Field of Classification Search

CPC .... F21V 23/06; F21V 21/005; F21V 23/008; F21V 19/00; F21V 19/003; F21V 19/008; F21Y 2101/02; F21S 2/005; F21S 4/28

See application file for complete search history.

(56) References Cited

U.S. PATENT DOCUMENTS

| | | | | |
|---|---|---|---|---|
| 5,463,280 | A | 10/1995 | Johnson | |
| 5,585,783 | A | 12/1996 | Hall | |
| 5,655,830 | A | 8/1997 | Ruskouski | |
| 5,688,042 | A | 11/1997 | Madadi et al. | |
| 5,947,588 | A | 9/1999 | Huang | |
| 5,949,347 | A | 9/1999 | Wu | |
| 5,952,916 | A | 9/1999 | Yamabe | |
| 6,220,722 | B1 | 4/2001 | Begemann | |
| 6,276,822 | B1 | 8/2001 | Bedrosian et al. | |
| 6,452,217 | B1 | 9/2002 | Wojnarowski et al. | |
| 6,465,961 | B1 | 10/2002 | Cao | |
| 6,585,393 | B1 * | 7/2003 | Brandes | A47F 3/001 362/219 |
| 6,634,770 | B2 | 10/2003 | Cao | |
| 6,635,987 | B1 | 10/2003 | Wojnarowski et al. | |

(Continued)

FOREIGN PATENT DOCUMENTS

| | | | |
|---|---|---|---|
| CN | 101655189 | A | 2/2010 |
| EP | 1058221 | A2 | 12/2000 |

(Continued)

OTHER PUBLICATIONS

LiquiLEDs, Liquid LED, http://www.liquidleds.com.tw/, Sep. 28, 2010, 1 page.

(Continued)

*Primary Examiner* — Bao Q Truong

(74) *Attorney, Agent, or Firm* — Dennis J. Williamson; Moore & Van Allen PLLC

(57) ABSTRACT

A modular lighting system has lamps that may be connected to one another such that current is carried between the lamps. The lamps include an enclosure that is at least partially optically transmissive. At least one LED is located in the enclosure that is operable to emit light through the enclosure when energized through an electrical path. A first electrical connector is provided for connecting the electrical path to a power source and a second electrical connector is configured to connect the electrical path to a second lamp.

20 Claims, 19 Drawing Sheets

(56) References Cited

U.S. PATENT DOCUMENTS

| | | | | |
|---|---|---|---|---|
| 6,639,360 | B2 | 10/2003 | Roberts et al. | |
| 6,746,885 | B2 | 6/2004 | Cao | |
| 6,853,151 | B2 | 2/2005 | Leong et al. | |
| 6,860,628 | B2 | 3/2005 | Robertson et al. | |
| 6,936,968 | B2 | 8/2005 | Cross et al. | |
| 7,048,410 | B2 | 5/2006 | Kutler | |
| 7,049,761 | B2 | 5/2006 | Timmermans et al. | |
| 7,114,830 | B2 | 10/2006 | Robertson et al. | |
| 7,307,391 | B2 | 12/2007 | Shan | |
| 7,510,299 | B2 | 3/2009 | Timmermans et al. | |
| 7,815,338 | B2 | 10/2010 | Siemiet et al. | |
| 7,926,975 | B2 | 4/2011 | Siemiet et al. | |
| 7,976,196 | B2 | 7/2011 | Ivey et al. | |
| 8,058,659 | B2 | 11/2011 | Bisberg | |
| 8,093,823 | B1 | 1/2012 | Ivey et al. | |
| 8,115,411 | B2 | 2/2012 | Shan | |
| 8,118,447 | B2 | 2/2012 | Simon et al. | |
| 8,231,245 | B2 * | 7/2012 | Weimer | F21S 4/008 362/249.02 |
| 8,247,985 | B2 | 8/2012 | Timmermans et al. | |
| 8,282,247 | B2 | 10/2012 | Ivey et al. | |
| 8,324,817 | B2 | 12/2012 | Ivey et al. | |
| 8,360,599 | B2 * | 1/2013 | Ivey | F21K 9/17 362/218 |
| 8,362,710 | B2 | 1/2013 | Langovsky | |
| 8,382,327 | B2 | 2/2013 | Timmermans et al. | |
| 8,419,223 | B2 * | 4/2013 | Withers | F21K 9/17 362/254 |
| 8,421,366 | B2 | 4/2013 | Palazzolo et al. | |
| 8,449,137 | B2 | 5/2013 | Dassanayake et al. | |
| 8,482,212 | B1 | 7/2013 | Ivey et al. | |
| 8,573,813 | B2 | 11/2013 | Ivey et al. | |
| 8,596,813 | B2 | 12/2013 | Ivey | |
| 8,746,933 | B2 * | 6/2014 | Cho | F21S 2/005 362/235 |
| 9,004,716 | B2 * | 4/2015 | Ai | F21K 9/17 362/217.17 |
| 9,115,858 | B2 * | 8/2015 | Levante | F21S 4/005 |
| 2002/0060526 | A1 | 5/2002 | Timmermans et al. | |
| 2004/0201990 | A1 | 10/2004 | Meyer | |
| 2009/0140271 | A1 | 6/2009 | Sah | |
| 2009/0184618 | A1 | 7/2009 | Hakata et al. | |
| 2010/0214779 | A1 * | 8/2010 | Kao | F21K 9/00 362/249.02 |
| 2010/0277098 | A1 * | 11/2010 | Sarna | F21S 2/00 315/294 |
| 2012/0040585 | A1 | 2/2012 | Huang | |
| 2012/0044689 | A1 * | 2/2012 | Kraus | F21S 4/003 362/249.02 |
| 2012/0051041 | A1 | 3/2012 | Edmond et al. | |
| 2014/0036505 | A1 * | 2/2014 | Barton | F21V 21/005 362/249.06 |
| 2014/0043804 | A1 | 2/2014 | Negley et al. | |

FOREIGN PATENT DOCUMENTS

| | | | |
|---|---|---|---|
| EP | 1475846 | A2 | 11/2004 |
| GB | 2345954 | A | 7/2000 |
| JP | H08162677 | A | 6/1996 |
| JP | H09265807 | A | 10/1997 |
| JP | 2000173304 | A | 6/2000 |
| JP | 2001118403 | A | 4/2001 |
| WO | 9833007 | | 7/1998 |
| WO | 0124583 | A1 | 4/2001 |
| WO | 0160119 | A2 | 8/2001 |
| WO | 2004100213 | A2 | 11/2004 |
| WO | 2010099755 | A1 | 9/2010 |
| WO | 2012011279 | A1 | 1/2012 |
| WO | 2012031533 | A1 | 3/2012 |

OTHER PUBLICATIONS

Cree, Inc., International Application No. PCT/US2011/062795, International Search Report and Written Opinion, Jun. 1, 2012.
U.S. Appl. No. 13/943,376, filed Jul. 16, 2013.
U.S. Appl. No. 13/943,455, filed Jul. 16, 2013.
U.S. Appl. No. 14/224,501, filed Mar. 25, 2014.
U.S. Appl. No. 13/772,436, filed Feb. 21, 2013.
U.S. Appl. No. 29/467,949, filed Sep. 25, 2013.
U.S. Appl. No. 13/943,152, filed Jul. 16, 2013.

* cited by examiner

LED LAMP AND MODULAR LIGHTING SYSTEM

BACKGROUND

Light emitting diode (LED) lighting systems are becoming more prevalent as replacements for older lighting systems. LED systems are an example of solid state lighting (SSL) and have advantages over traditional lighting solutions such as incandescent and fluorescent lighting because they use less energy, are more durable, operate longer, can be combined in multi-color arrays that can be controlled to deliver virtually any color light, and generally contain no lead or mercury. A solid-state lighting system may take the form of a lighting unit, light fixture, light bulb, or a "lamp."

An LED lighting system may include, for example, a packaged light emitting device including one or more light emitting diodes (LEDs), which may include inorganic LEDs, which may include semiconductor layers forming p-n junctions and/or organic LEDs (OLEDs), which may include organic light emission layers. Light perceived as white or near-white may be generated by a combination of red, green, and blue ("RGB") LEDs. Output color of such a device may be altered by separately adjusting supply of current to the red, green, and blue LEDs. Another method for generating white or near-white light is by using a lumiphor such as a phosphor. Still another approach for producing white light is to stimulate phosphors or dyes of multiple colors with an LED source. Many other approaches can be taken.

SUMMARY OF THE INVENTION

In some embodiments, a lighting system comprises a lamp where the lamp comprises an enclosure that is at least partially optically transmissive. At least one LED is located in the enclosure and is operable to emit light through the enclosure when energized through an electrical path. The lamp also comprises a first electrical connector for connecting the electrical path to a power source and a second electrical connector configured to connect the electrical path to a second lamp.

The enclosure may comprise a base made of a thermally conductive material where the base is thermally coupled to the at least one LED. A plurality of LEDs may extend for substantially the length of the base. The enclosure may comprise an optically transmissive lens. The lens may be connected to the base where the base may comprise a first channel and a second channel for receiving a first edge and a second edge of the lens, respectively. The at least one LED may be mounted on a LED board that provides physical support for the at least one LED and forms part of the electrical path. The LED board may comprise a FR4 board. The LED board may be mounted on the base. The first electrical connector may comprise a power cord. The first electrical connector may be configured to connect to a second lamp. The first electrical connector and the second electrical connector may comprise one of a male plug and a female plug. The second electrical connector may comprise a cable that extends from the lamp and terminates in one of a male plug and a female plug. A second lamp may comprise a third connector configured to connect to the second connector. The third connector may comprise one of a male and female plug connected to the second lamp by a flexible cable. The lamp may abut the second lamp when the third connector is connected to the second connector. A bracket may be provided for connecting the lamp to the second lamp. The third connector and the second connector may be located inside one of the lamp and the second lamp. The third connector and the second connector may be located inside of an end cap of one of the lamp and the second lamp where a section of the end cap may be removable to provide access to the third connector and the second connector. The lamp may comprise a base and a bracket releasably connected to the base where the bracket comprises a mounting mechanism for mounting the bracket to a support surface. The enclosure may comprise an optically transmissive lens and a base where the at least one LED is mounted on a LED board and a portion of the lens holds the LED board against the base.

DETAILED DESCRIPTION

Figure 1:
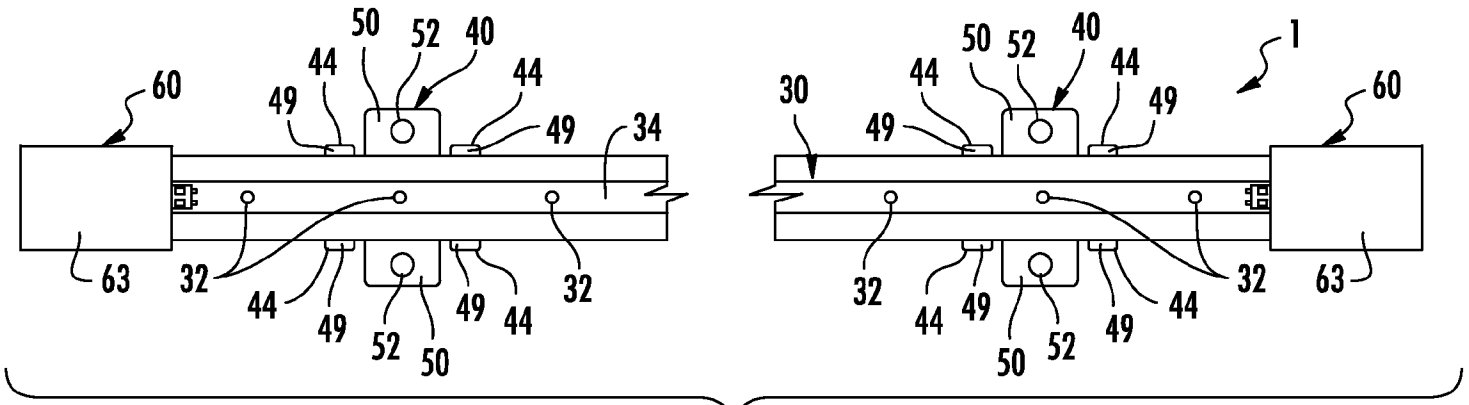
FIG. 1 is a top view showing an embodiment of a LED lamp of the invention.
Figure 2:
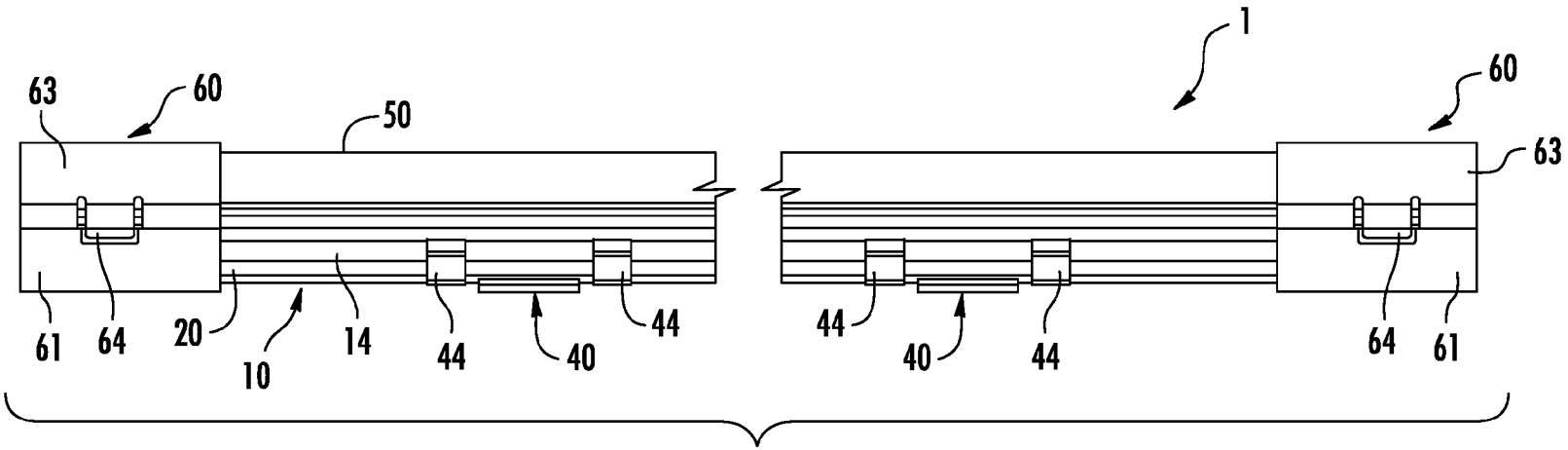
FIG. 2 is a side view of the LED lamp of FIG. 1.
Figure 3:
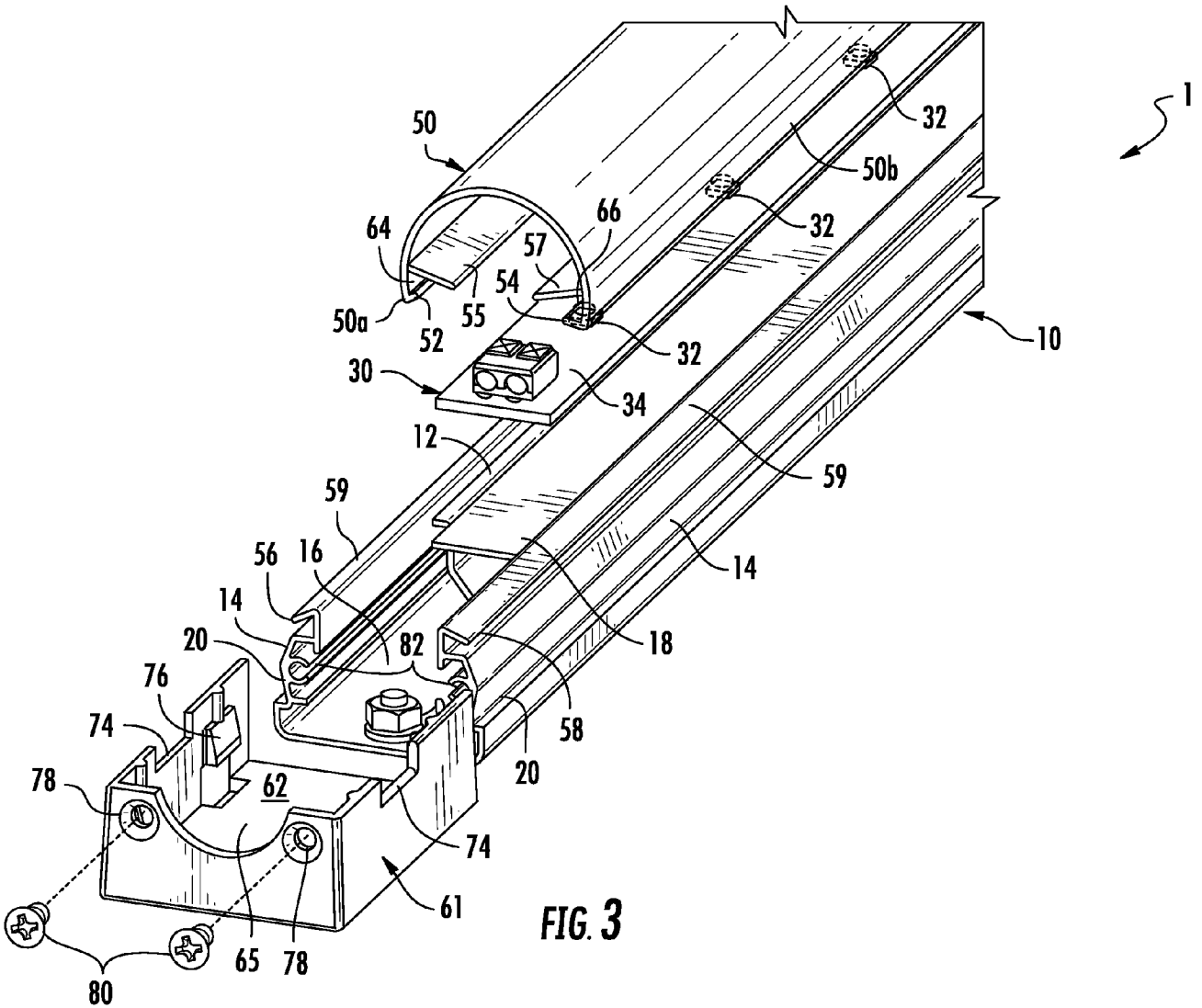
FIG. 3 is a partial exploded view of the LED lamp of FIG. 1.
Figure 4:
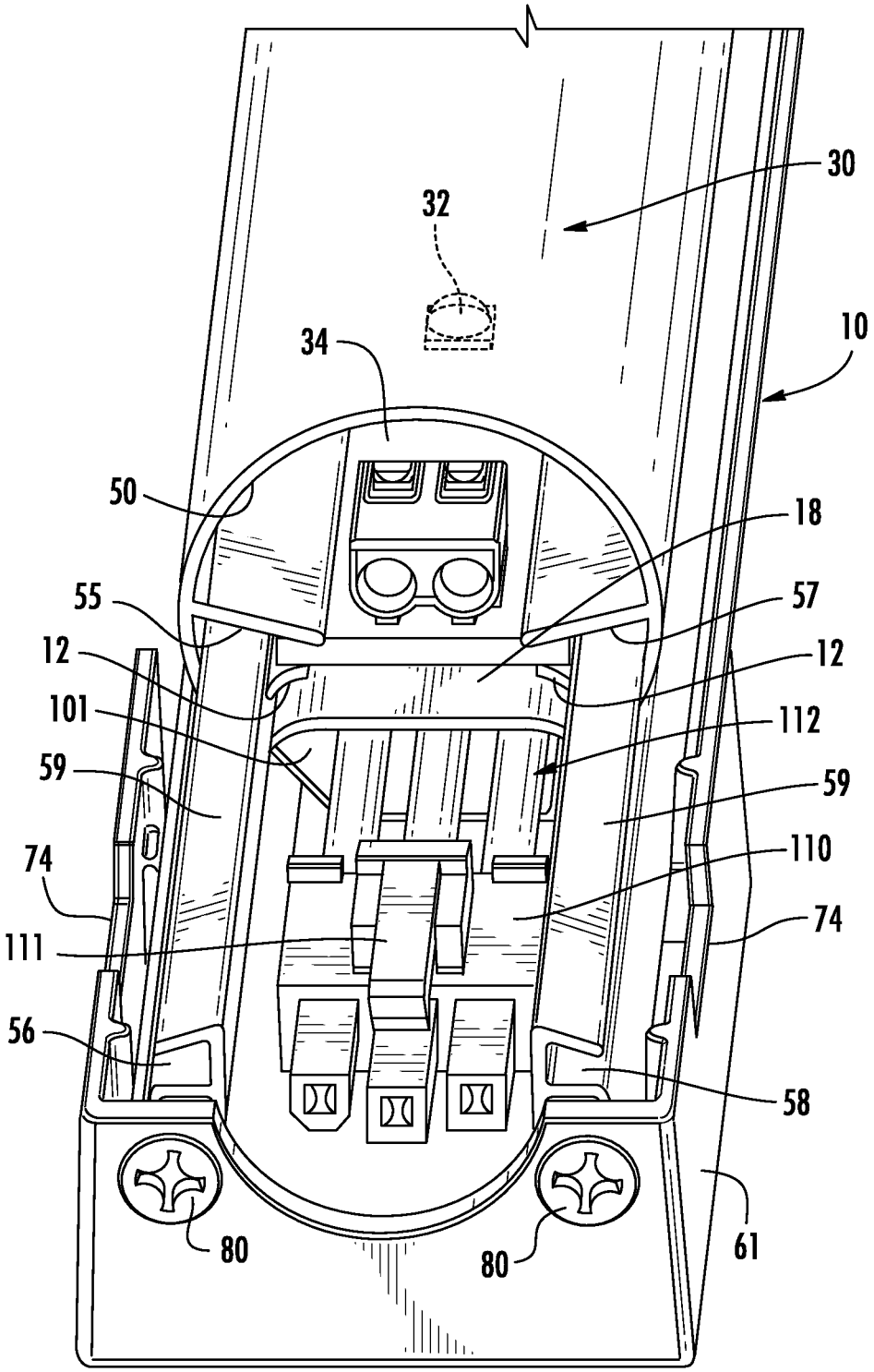
FIG. 4 is a partial perspective view of the LED lamp of FIG. 1 in a first position.

Embodiments of the present invention now will be described more fully hereinafter with reference to the accompanying drawings, in which embodiments of the invention are shown. This invention may, however, be embodied in many different forms and should not be construed as limited to the embodiments set forth herein. Moreover, the various aspects of the embodiments as described herein may be used in combination with any other aspects of the embodiments as described herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" or "top" or "bottom" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

The terms "LED" and "LED device" as used herein may refer to any solid-state light emitter. The terms "solid state light emitter" or "solid state emitter" may include a light emitting diode, laser diode, organic light emitting diode, and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials. A solid-state lighting device produces light (ultraviolet, visible, or infrared) by exciting electrons across the band gap between a conduction band and a valence band of a semiconductor active (light-emitting) layer, with the electron transition generating light at a wavelength that depends on the band gap. Thus, the color (wavelength) of the light emitted by a solid-state emitter depends on the materials of the active layers thereof. In various embodiments, solid-state light emitters may have peak wavelengths in the visible range and/or be used in combination with lumiphoric materials having peak wavelengths in the visible range. Multiple solid state light emitters and/or multiple lumiphoric materials (i.e., in combination with at least one solid state light emitter) may be used in a single device, such as to produce light perceived as white or near white in character. In certain embodiments, the aggregated output of multiple solid-state light emitters and/or lumiphoric materials may generate white light.

Solid state light emitters may be used individually or in combination with one or more lumiphoric materials (e.g., phosphors, scintillators, lumiphoric inks) and/or optical elements to generate light at a peak wavelength, or of at least one desired perceived color (including combinations of colors that may be perceived as white). Inclusion of lumiphoric (also called 'luminescent') materials in lighting devices as described herein may be accomplished by direct coating on solid state light emitter, adding such materials to encapsulants, adding such materials to lenses, by embedding or dispersing such materials within lumiphor support elements, and/or coating such materials on lumiphor support elements. Other materials, such as light scattering elements (e.g., particles) and/or index matching materials, may be associated with a lumiphor, a lumiphor binding medium, or a lumiphor support element that may be spatially segregated from a solid state emitter.

Linear lights such as fluorescent lights may comprise a fluorescent tube releasably mounted in a fixture that may be mounted on a ceiling or other structure. One use of linear lights is as down and/or up lighting in commercial fixtures where the light is mounted in a rack or other merchandise display to illuminate displayed merchandise. Such linear lights may also be used in non-commercial applications such as a down light mounted under a kitchen cabinet, for example, to provide down lighting on a counter or other surface. Linear lights are used in a variety of applications to provide down lighting, up lighting, and/or accent lighting in a variety of applications. Because LED based solid state lamps use less energy, are more durable, operate longer, can be combined in multi-color arrays that can be controlled to deliver virtually any color light, and generally contain no lead or mercury the conversion to, or replacement of linear lighting systems such as fluorescent lighting systems with LED lighting systems is desired. "Linear light" as used herein means a lamp having an illuminated enclosure that has a significantly longer length than width. For example the linear light of the invention may be approximately 1-3 inches in width with a length of between approximately 12-80 inches.

In one embodiment the LED lamp 1 comprises a base 10. The base 10 may be made of a thermally conductive material such that it functions as a heat sink to dissipate heat from the LED assembly. The base 10 may be made of a rigid material to support the LED assembly 30 and lens 50. In some embodiments the base 10 may be made of extruded aluminum. While aluminum may be used, other rigid, thermally conductive materials and manufacturing processes may be used to form the base 10. The base 10 defines a support surface for the LED assembly 30 that may be comprised of a pair of planar support surfaces such as flanges 12 that support the longitudinal edges of the LED assembly 30 along the length thereof. The spaced flanges 12 may be used as the support surface in embodiments where the LED assembly 30 comprises a generally rigid substrate that is capable of spanning the flanges 12 and physically supporting the LEDs 32. In one embodiment the flanges 12 extend for the length of the LED assembly 30; however, the flanges 12 may extend for less than the entire length of the LED assembly provided that they adequately support and retain the LED assembly 30. For example, gaps may be provided in the flanges 12 while still adequately supporting the LED assembly. The flanges 12 face one another to create a planar support for receiving and supporting the LED assembly 30. The LED assembly 30 may be thermally coupled to the base 10 such that heat generated by the LEDs 32 is transferred to the base 10 via the LED board 34 and is dissipated to the ambient environment by the base 10. The thermal couple between the LED board 34 and base 10 may be provided by providing surface to surface contact between the board 34 and the base 10. In other embodiments thermally conductive layers may be provided between the base 10 and the board 34. For example, thermal adhesive may be used to attach the board 34 to the base 10. In some embodiments the support surface may comprise a planar member that extends across the entire width of the LED assembly rather than two spaced flanges 12.

Figure 28:
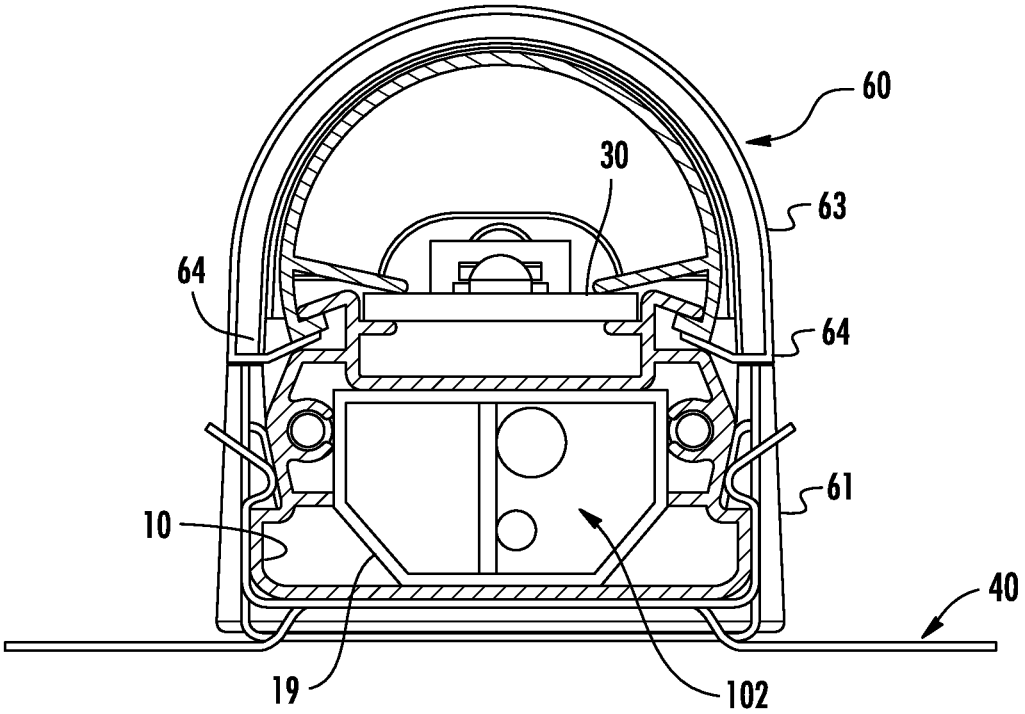
FIG. 28 is a section view of the lamp of FIG. 1.

The flanges 12 are supported on side walls 14 that extend generally perpendicularly from a bottom wall 16. A cross member 18 may be provided between the side walls 14 to provide structural rigidity to the base 10 such that the base 10 does not flex or bend and to define a wire way 101 for containing the lamp electronics 102, such as the power supply and other electronics, and wiring as shown in FIG. 28.

Figure 13:
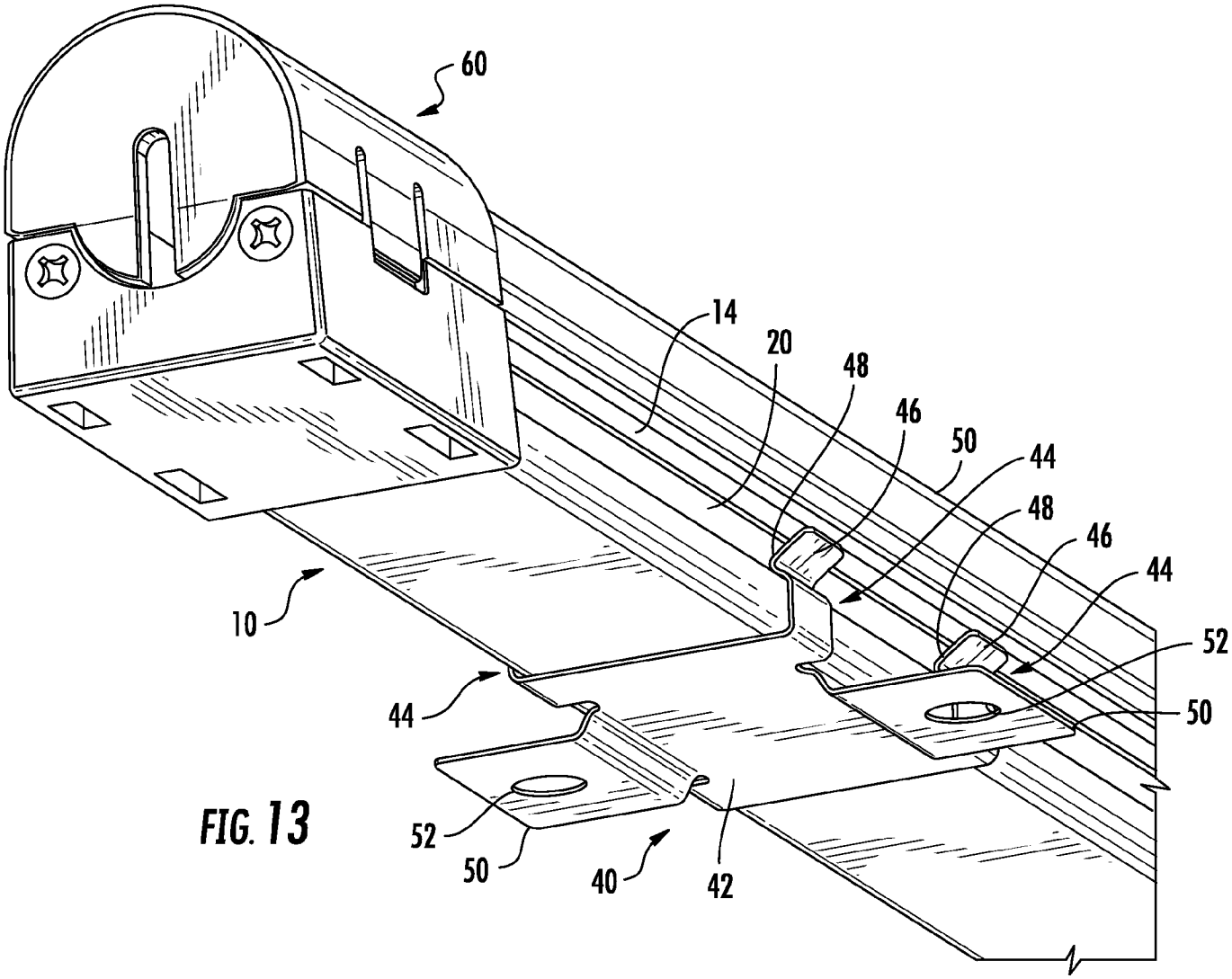
FIGS. 13-16 are perspective views showing embodiments of a mounting bracket used with the lamp of FIG. 1.

The side walls 14 define grooves 20 that extend for the length of, or for a portion of the length of, the base 10. The grooves 20 may be engaged by mounting brackets 40 for securing the lamp to a surface. Different embodiments of the mounting bracket 40 may be used for different mounting applications. Referring to FIG. 13 in one embodiment the mounting bracket 40 comprises a base plate 42 that extends for approximately the width of the base 10. At least one engagement member 44 extends from each end of the base plate 42 for releasably engaging the side walls 14 of the base 10 such that the lamp may be secured to the bracket 40. In one embodiment the engagement members 44 comprise resilient tabs 46 that extend from the base plate 42 and that are shaped and dimensioned to engage the grooves 20 formed on the side walls 14 of base 10. Each tab 46 includes a protrusion 48 that is shaped and dimensioned to fit into grooves 20 to mechanically lock the base 10 to the brackets 40. The tabs 46 may be resiliently mounted relative to the base plate 42 such that the tabs 46 may flex to releasably engage the base 10. The tabs 46 may be arranged in opposed pairs to clamp the base 10 therebetween. While two tabs 46 are shown on each end of the bracket 40 a greater or fewer number of tabs may be used. The base plate 40 and tabs 46 may be formed of a single piece of deformable, resilient material such as steel where the resiliency of the material is used to create the bias force of the tabs 46 against the base 10. In other embodiments the tabs may be formed of separate members that are mounted to the base plate at a hinges and that are biased into engagement with the base by separate springs.

The tabs 46 may be formed with flared ends that create angled camming surfaces 49 where the surfaces 49 are oriented such that the base 10 may be centered between and pushed against the camming surfaces 49 to flex the tabs 46 and allow the base 10 to be inserted between the opposing tabs 46. When the force on the tabs 46 is released, such as when the protrusions 48 on the tabs 46 are aligned with the grooves 20, the tabs 46 return toward the undeformed position to create a gripping force on the base 10 sufficient to hold the lamp 1 in the brackets 40. The use of elongated grooves 20 and resilient tabs 46 allow the brackets 40 to be located at any position along the length of the base 10. The base 10 may also be slid relative to the brackets 40 to allow adjustment of the position of the lamp relative to the brackets 40 after the base 10 is mounted in the brackets 40. Typically a plurality of brackets 40 may be used to support a lamp depending upon the length and weight of the lamp.

In the embodiment of FIG. 13 bracket 40 comprises a pair of mounting flanges 50 that comprise apertures 52 for receiving fasteners such as screws that may be used to secure the bracket 40 to a support surface. The mounting flanges 50 extend from the plate 42 such that apertures 52 are disposed to either side of the lamp 1 where the apertures 52 are accessible when the lamp 1 is mounted in the bracket 40. While circular apertures for receiving separate fasteners such as screws are shown, the mounting apertures 52 may comprise various shaped and sized apertures, slots, channels or the like for receiving any type of fastener. Moreover, the flanges 50 may comprise mounting mechanisms other than apertures if desired. For example, the mounting mechanisms may comprise male or female engagement members that engage separate female or male brackets that are mounted to the support surface. Other mechanisms such as adhesive, hook and loop fasteners or the like may also be used.

Figure 14:
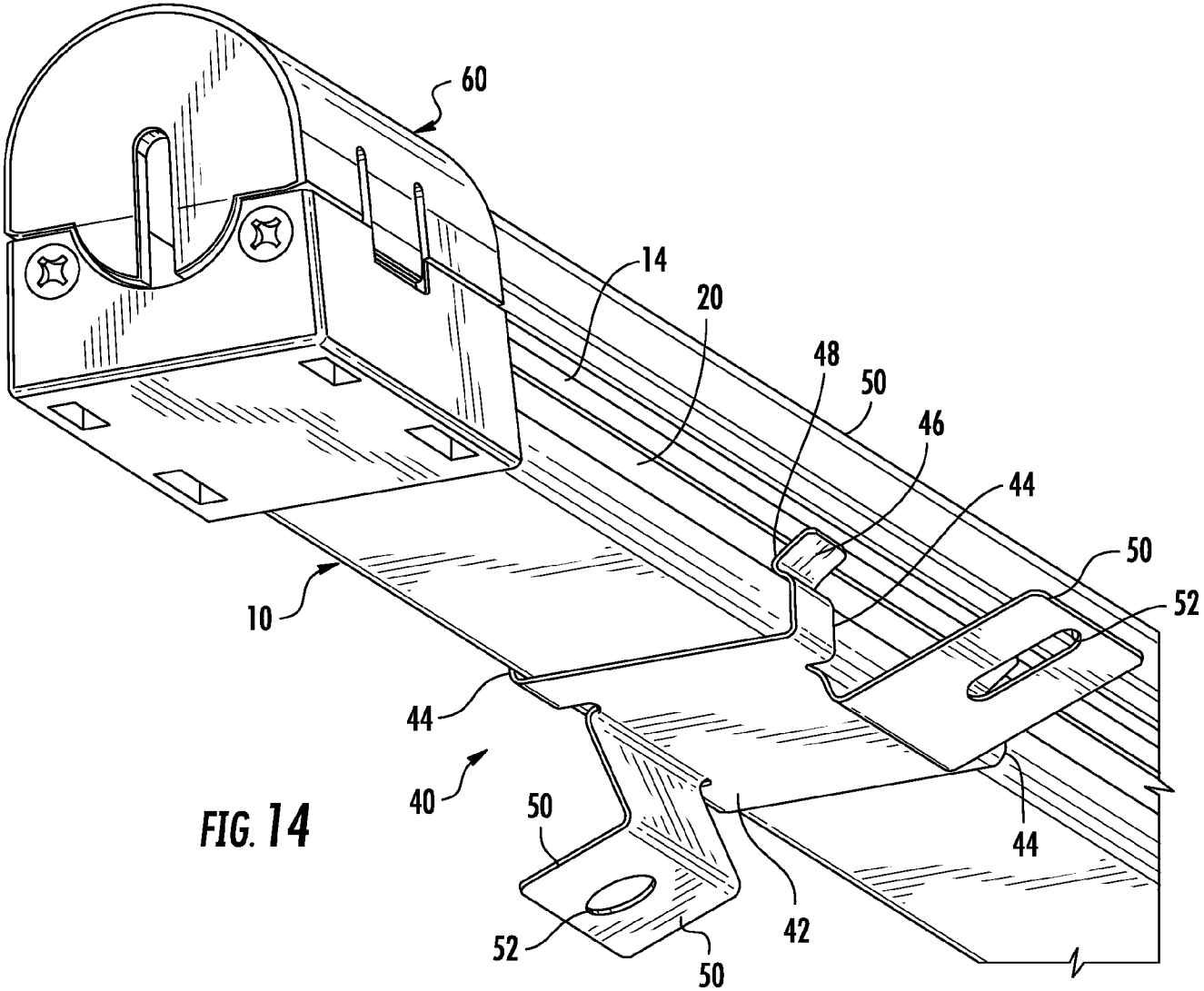
Figure 15:
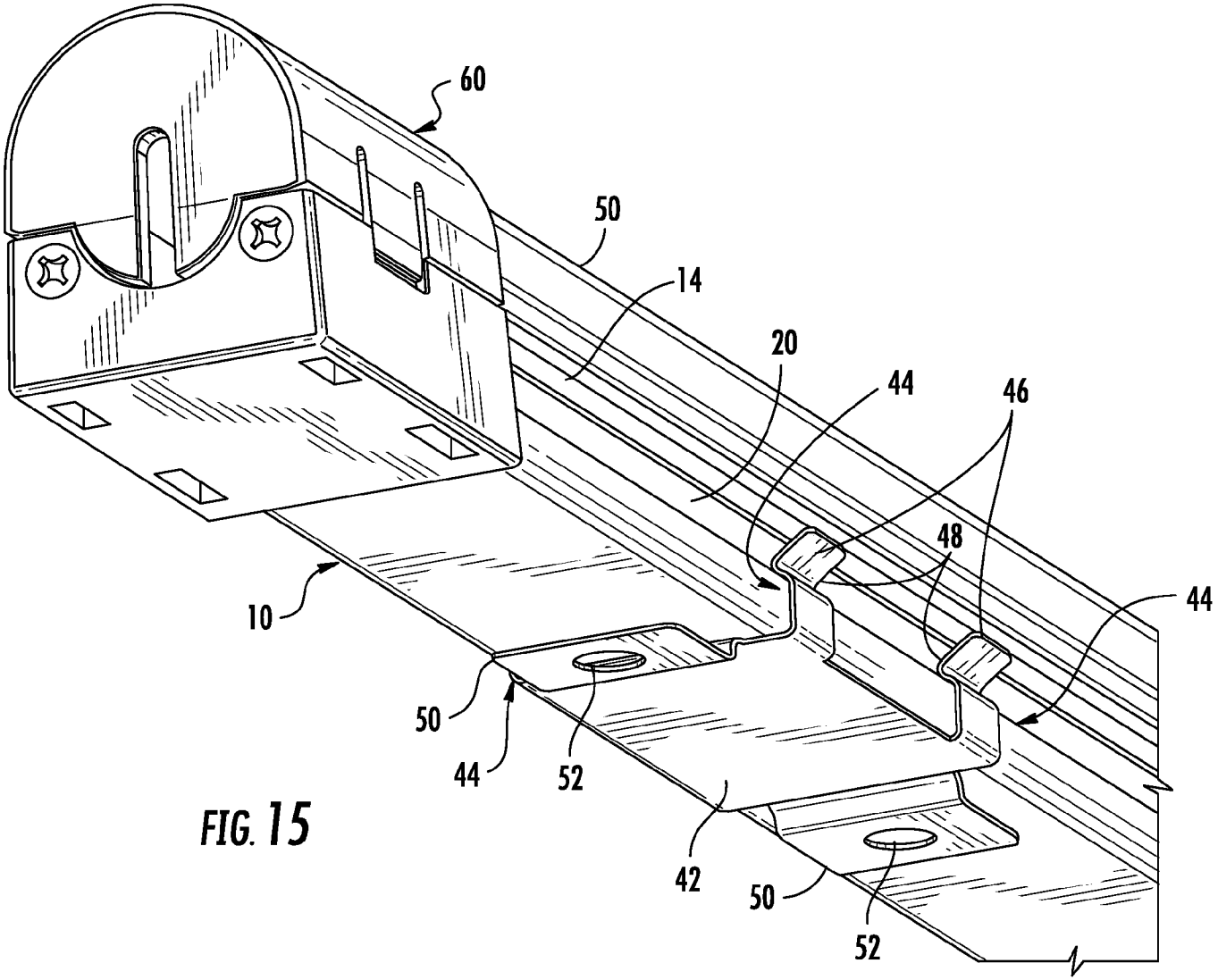
Figure 16:
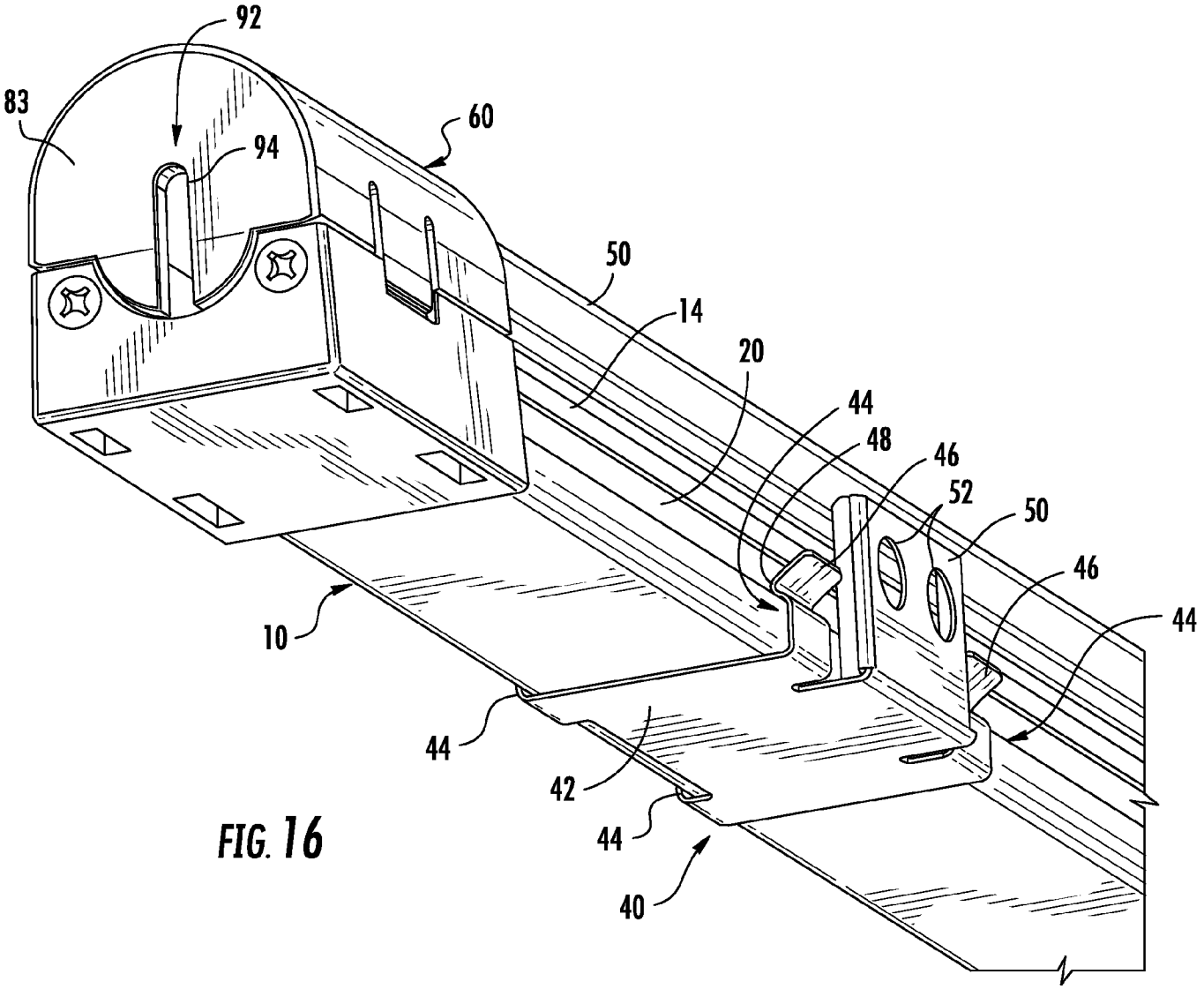

FIG. 14 shows an alternate embodiment for the mounting bracket where the mounting flanges 50 are angled relative to the plate 42 to define a plane that is disposed at an angle relative to the lamp such that when the flanges 50 are mounted on a support surface the base plate 42 and the lamp 1 are mounted at an angle relative to the support surface. FIG. 15 shows an alternate embodiment for the mounting bracket where the mounting flanges 50 extend from the sides of the base plate 42 rather than from the ends of the base plate such that the mounting flanges 50 are hidden from view after the lamp is mounted on the brackets 40. In this embodiment the brackets 40 are mounted to the support surface before the lamp 1 is installed in the brackets 40. FIG. 16 shows another alternate embodiment for the mounting bracket 40 where the mounting flange 50 extends from the end of the base plate 42 but is disposed at approximately a 90 degree angle relative to the base plate 42 such that the mounting flange 50 extends along one side wall 14 and the lamp is oriented at a 90 degree angle relative to the support surface. Other arrangements of the bracket may also be provided.

The LED lamp 1 comprises an LED assembly 30 that may be supported by and secured to the base 10. The LED assembly 30 may comprise a plurality of LEDs or LED packages 32 that are mounted on LED board 34 and that extend the length of, or substantially the length of, the base 20 to create a desired light pattern. The LEDs 32 may be arranged such that the light pattern extends the length of, or for a substantial portion of the length of, the lamp and is similar in length to a traditional fluorescent bulb. While in one embodiment the LEDs 32 extend in a line for substantially the entire length of the base 10, the LEDs 32 may be arranged in other patterns and may extend for less than substantially the entire length of the base if desired. For example, the LEDs may be disposed along the edges of the LED board 34 and directed toward the middle of the lamp. The LEDs may be directed into a waveguide. The LEDs 32 may be mounted on a LED board 34 that provides physical support for the LEDs 32 and provides an electrical path for providing electrical power to the LEDs. The electrical path provides power to the LEDs and may comprise the power source, board 34 and lamp electronics 102. In one embodiment the board 34 comprises an FR4 board. In an FR4 board circuitry 103 may be etched into a copper layer of the board where the circuitry comprises a portion of the electrical path to the LEDs 32. In other embodiments the board may comprise a MCPCB, lead frame or other suitable mounting substrate for the LEDs. The board may also comprise a flex circuit. Because a flex circuit is inherently flexible the flex circuit may be supported on a rigid substrate if needed. The board 34 may comprise the electrical circuitry 103 and components that form part of the electrical path to the LEDs 32. With embodiments of the invention, the term "electrical path" can be used to refer to the entire electrical path to the LED array, including an intervening power supply disposed between the electrical connection that would otherwise provide power directly to the LEDs and the LED array, or it may be used to refer to the connection between the mains and all the electronics in the lamp, including the power supply. The term may also be used to refer to the connection between the power supply and the LED array.

The LEDs 32 may be provided in a variety of patterns and may include a wide variety of different types and colors of LEDs to produce light in a wide variety of colors and/or light patterns. In some embodiments LEDs as disclosed herein may include one or more light affecting elements (including light transmissive, light-absorptive, light reflective and/or lumiphoric materials) formed on, over or around at least one solid state light emitter. In one embodiment for a 48 inch lamp twenty two LEDs may be used arranged in-line and having a 2 inch spacing between LEDs. The LEDs may comprise XT-E LEDs manufactured and sold by CREE Inc. In some embodiments the LED board 34 may comprise a plurality of fixtures electrically interconnected to make LED board 34. In one embodiment each fixture is 15 W, 1700 Lm, 125 mA @ 120V. Other LEDs and/or combinations of LEDs may be used depending on the desired characteristics of the emitted light. For example, in some embodiments, the LEDs may be center mounted with greater side emitting optical profiles such as CREE XPQ LEDs. In some embodiments a prismatic lens or parabolic reflectors may be used to create a desired light distribution.

The base 10 and LED assembly 30 may be made of, or covered in, a light reflective material, such as MCPET, white optic, reflective film or paint or the like, to reflect light from these components into mixing chamber 51. The entire base 10 and/or board 34 may be made of, or covered in, a reflective material or portions of the base and/or board may be made of reflective material. For example, portions of the base and/or board that may be exposed to the emitted light may be made of, or covered in, a reflective material.

A lens 50 may be connected to the base 10 to cover the LED assembly 30 and create a mixing chamber 51 for the light emitted from the LEDs 32. The light is mixed in the chamber 51 and is emitted from the lamp through the lens 50. The lens 50 may diffuse the light to provide a uniform, diffuse, color mixed light pattern. The lens 50 may be made of molded plastic or other material and may be provided with a light diffusing layer. In the drawings the lens is shown as transparent to better illustrate the internal components of the lamp; however, in actual use the lens may be diffusive such that it is light transmissive but not necessarily transparent. The light diffusing layer may be provided by etching, application of a coating or film, by the translucent or semitransparent material of the lens, by forming an irregular surface pattern during formation of the lens or by other methods. In some embodiments the lens 50 has a round or circular cross-sectional shape, however, the lens may have other shapes including a flattened circular shape or oval, a faceted shape, a rectilinear, square or rectangular shape or other suitable shape.

The lens 50 extends substantially the length of the base 10 to cover the LEDs 32. In some embodiments, the longitudinal edges 50*a*, 50*b* of the lens 50 are provided with inwardly facing lips or projections 52 and 54 that may be received in outwardly facing longitudinal C-channels 56, 58 formed along the side walls 14 of the base 10. The channels 56, 58 may be formed by a portion of walls 14 and outwardly facing angled members 59. The lens 50 and projections 52, 54 may be formed as one piece such as of molded plastic. In some embodiments, the base 10 may be formed of extruded, stamped or rolled metal where the channels 56, 58 are formed as one-piece with the base; however, the base may be made as separate components secured together to form the completed base. The projections 52, 54 are inserted into the channels 56, 58 and mechanically engage the members 59 to retain the lens 50 on the base 10. The projections 52, 54 may be slid into the channels 56, 58 from the end of the base 10. If the lens 50 is made of an elastic material, such as molded plastic, the projections 52, 54 may also be inserted into the channels 56, 58 by inserting a first projection 52 into one of the channels 56 and deforming the lens to insert the opposite projection 54 into the opposite channel 58. The lens 50 may then be released such that the lens elastically returns to its original shape where the projections 52, 54 are forced into the opposed channels 56, 58.

The lens 50 comprises a second set of inwardly facing flanges 55, 57 that are spaced from the projections 52, 54, respectively, to trap the outwardly facing members 59. The flanges 55, 57 are dimensioned such that when the lens 50 is secured to the base 10 the flanges 55, 57 engage the top surface of the board 34 to clamp the board 34 between the flanges 55, 57 and the flanges 12.

End caps 60 may be provided at the opposite ends of the lens 50 and base 10 to close the interior mixing chamber 51 of LED lamp 1 and to support the electrical connectors for connecting the LEDs to a power source. The end caps 60, base 10 and lens 50 together define an enclosure that retains the LEDs 32. The enclosure is partially optically transmissive through the lens 50.

Each end cap 60 comprises an internal chamber 62 defined by a bottom section 61 and a top section 63 dimensioned and shaped to closely receive the base 10, and lens 50. The bottom section 61 is formed with protrusions 76 that engage the grooves 20 formed in the base 10. To secure the bottom section 61 of the end cap 60 to the base 10, the bottom section 61 may be slid over the base such that the protrusions 76 slide into grooves 20 and the bottom wall 16 of base 10 rests on the bottom wall 65 of end cap 60. The bottom section 61 further comprises apertures 78 for receiving fasteners 80 such as screws that engage mating holes 82 formed in the base 10.

In one embodiment the top section 63 is provided with two deformable locking members 64 that engage the base 10 such that the top section 63 may be removed from the lamp. The locking members 64 are made of resilient material and have a first end connected to the top section 63 and an engagement member 66 at the free end that engage channels 56, 58 formed on the base 10. The locking members 64 may be deformed by the base 10 as the top section is attached to the bottom section 61. To facilitate the deformation of the locking members 64 the ends of the locking members 64 are formed with angled camming surfaces 65 that are engaged by the camming surfaces 59 as the top section 63 is mounted on the bottom section. When the engagement members 66 are aligned with channels 56, 58, the locking members 64 return to the undeformed locking position such that the engagement members 66 are biased into engagement with the base 10. The engagement of the engagement members 66 with the side walls 14 of the base 10 secures the top section 63 of end cap 60 to the base 10. The locking members 64 are located in recesses 74 formed in the bottom section 61 to fix the lateral position of the top section 63 relative to the bottom section 61. Other arrangements of snap-fit connectors may be used. For example a fewer or greater number of locking members 64 may be used. The deformable locking members may be formed on the base 10 and apertures or other mating receptacles may be formed on the end caps. Rather than using deformable resilient members the locking members may comprise rigid members that are biased to the locking position by separate springs. While use of a snap-fit connector provides a simple assembly method that does not require additional tools, assembly steps or fasteners, the top section 63 may be connected to the bottom section 61 using other connection mechanisms such as separate fasteners, or the like.

Figure 6:
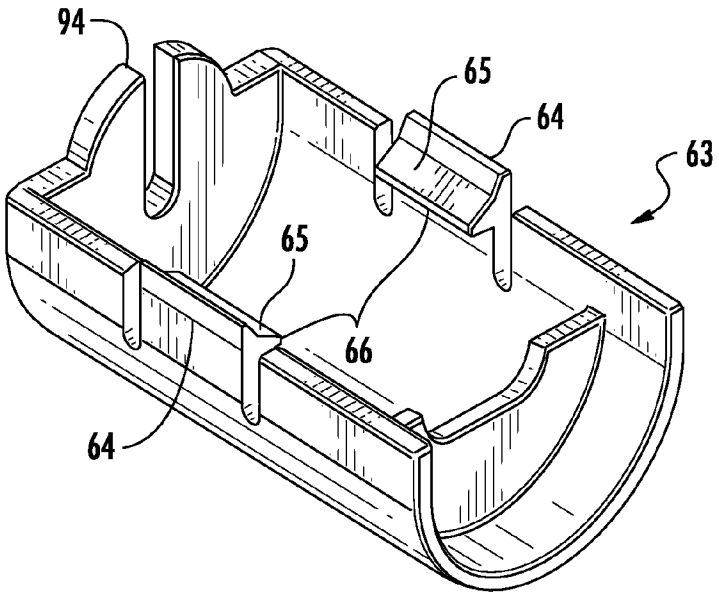
FIGS. 5 and 6 are perspective views of one embodiment of the top section of the end cap used in the LED lamp of FIG. 1.
Figure 5:
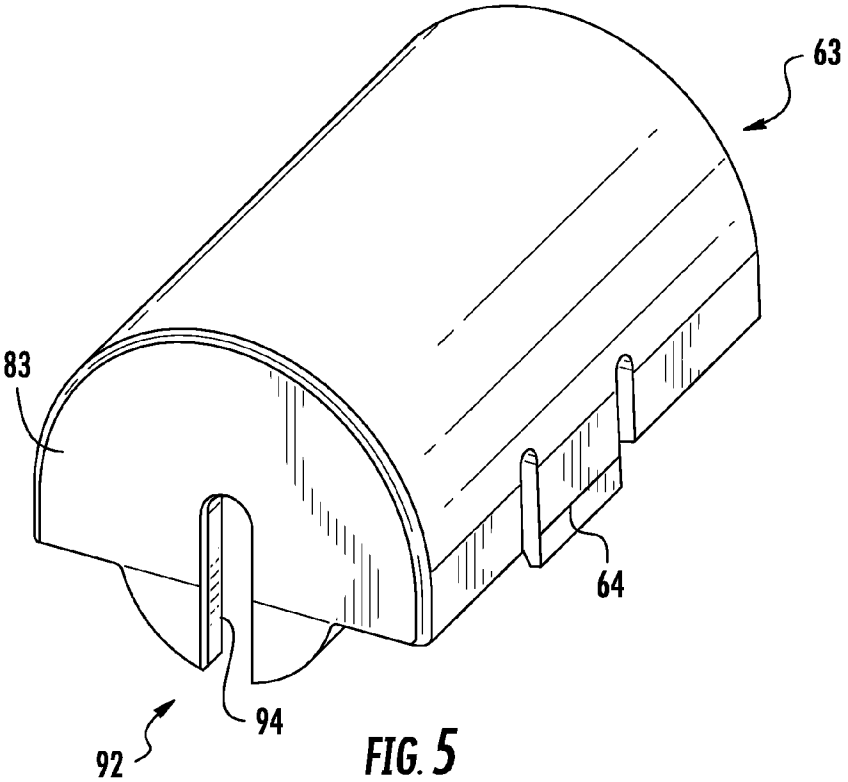
Figure 8:
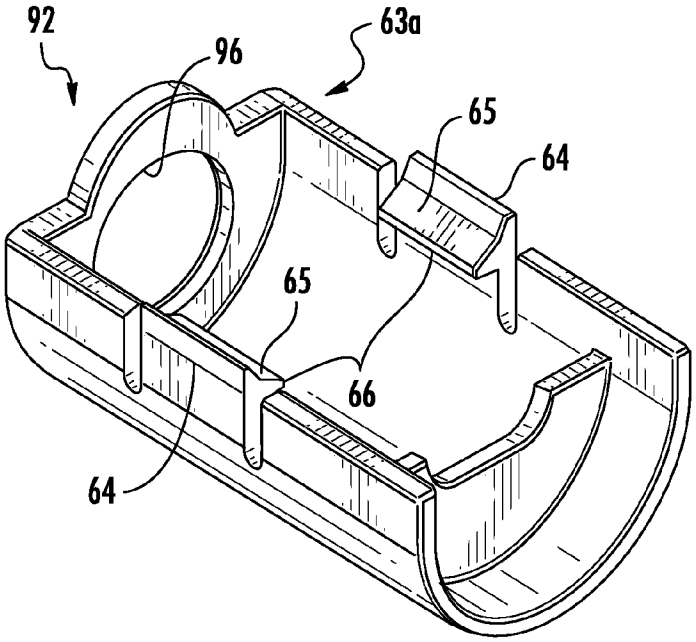
FIGS. 7 and 8 are perspective views of a second embodiment of the top section of the end cap used in the LED lamp of FIG. 1.
Figure 7:
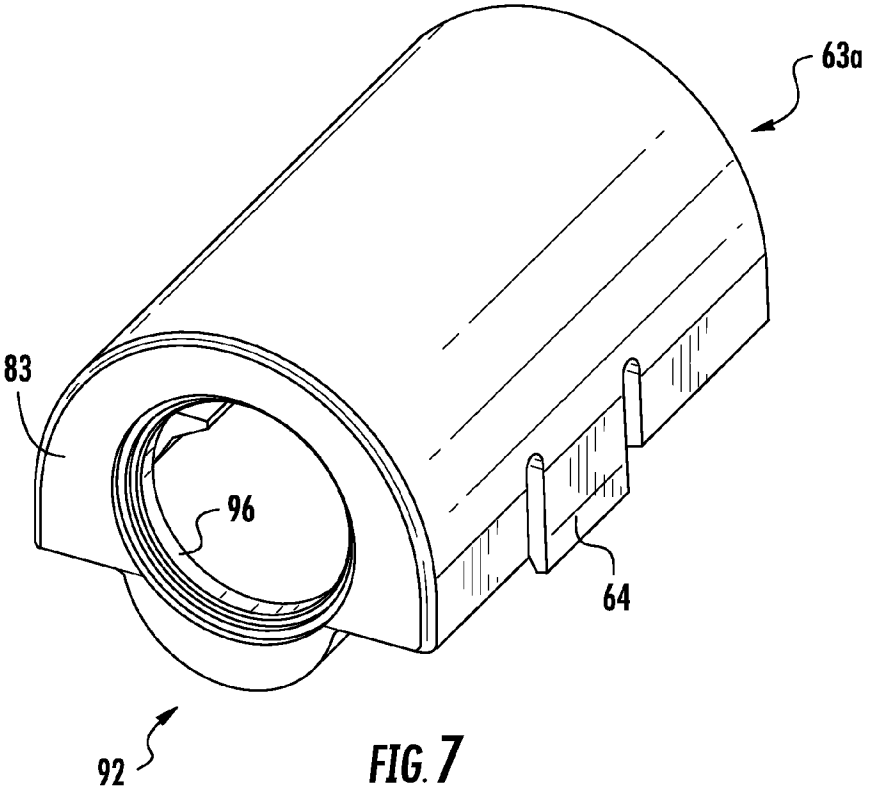
Figure 10:
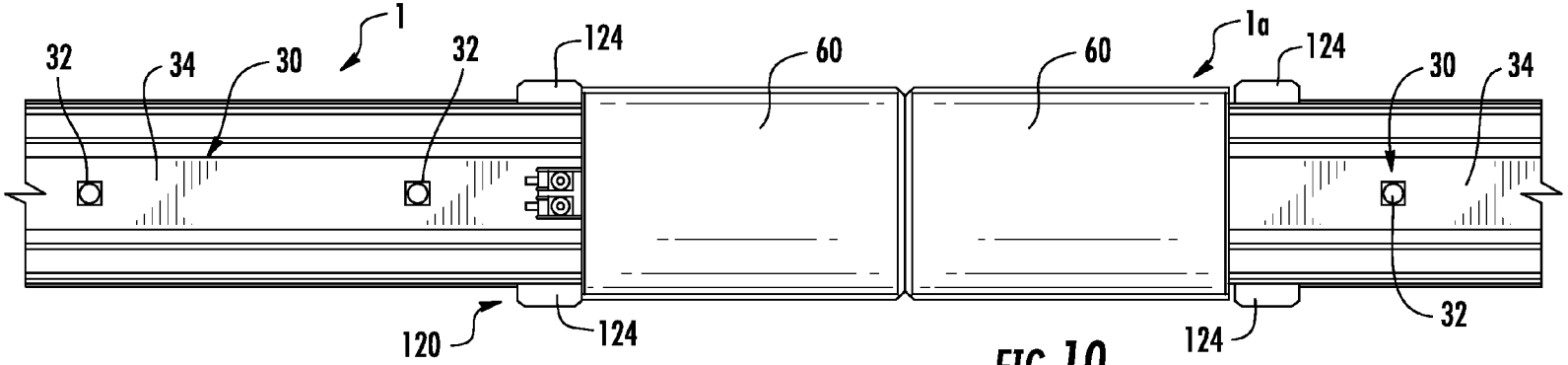
FIG. 10 is a top view showing two LED lamps connected together.
Figure 9:
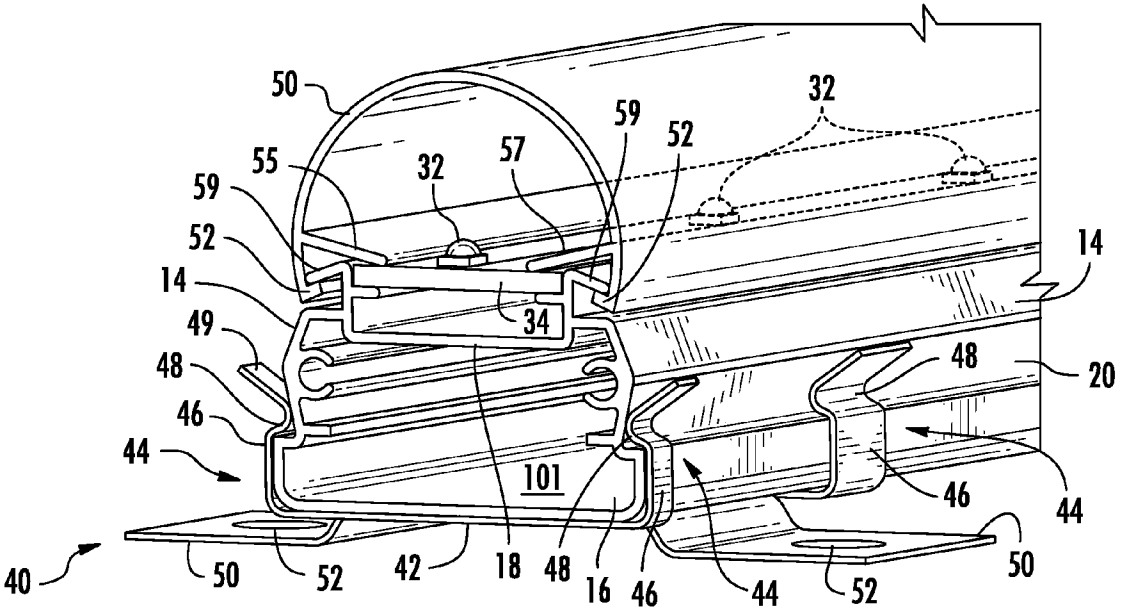
FIG. 9 is a partial perspective section view of the LED lamp of FIG. 1.
Figure 11:
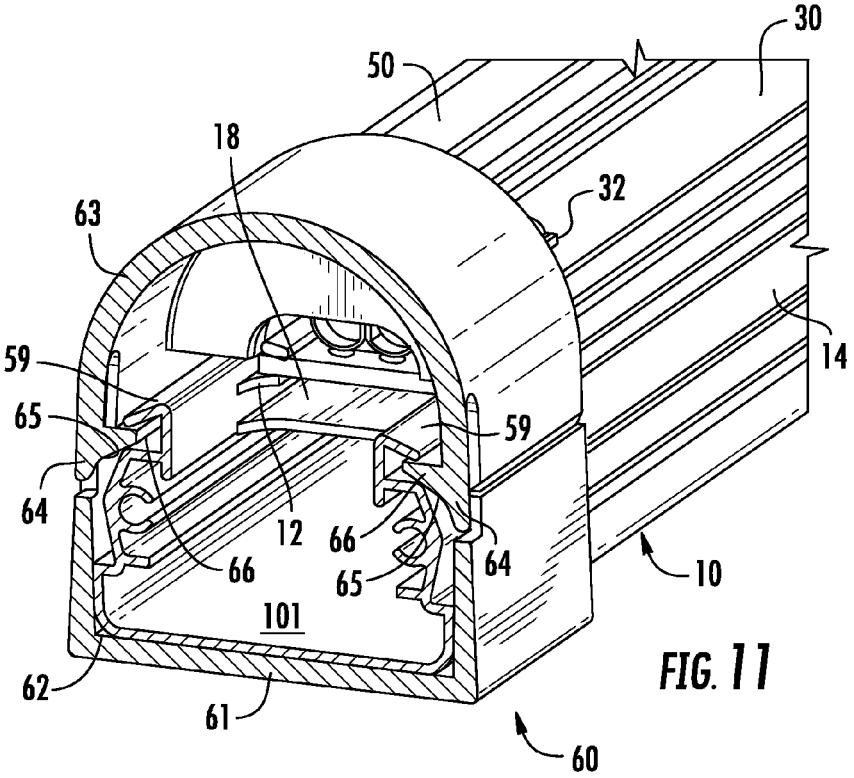
FIG. 11 is a partial perspective section view of the LED lamp of FIG. 1.
Figure 12:
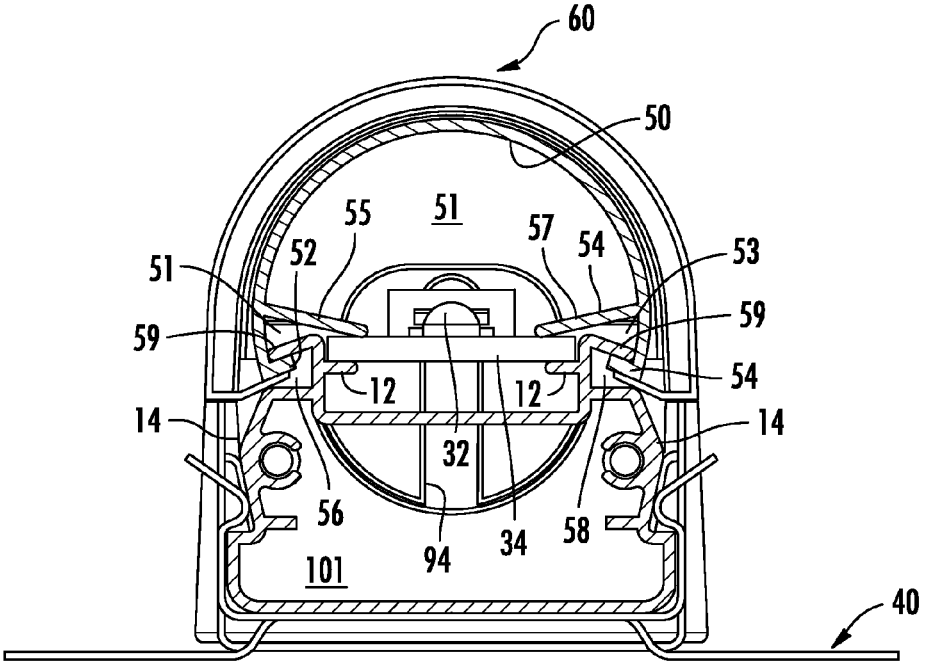
FIG. 12 is a section view of the LED lamp of FIG. 1.

Referring to FIGS. 5 and 6 the end wall 83 of the top section 63 defines an aperture 92 for receiving an electrical connector of the lamp. In one embodiment the top section 63 is formed with a slotted aperture 94 for receiving the internal wiring of the lamp such that an electrical connector may be extended to the outside of the lamp with the wiring to the connector passing through the slot 94. Referring to FIGS. 7 and 8 in a second embodiment the top section 63*a* comprises an aperture 92 where the aperture is round aperture 96 formed in end wall 83 that receives a cable 98 that connects to the electrical path of the lamp (See, for example, FIG. 17). The cable 98 may be held in a strain relief collar or grommet 100 secured in the aperture 96. The choice of top section 63, 63*a* is selected based on the type of connector used to connect to the electronics of the lamp as will be described.

The lamp of the invention may be used as part of a modular system allowing multiple lamps to be connected together to create a linear light of varying length. In one embodiment the lamp has a length and a diameter suitable for use as a replacement for existing linear lights such as fluorescent tubes. For example, in one common application the lamp may have a length of approximately 48 inches that is sized to replace a 48 inch light fixture. While a specific length has been described it will be appreciated that the lamp may be made in any suitable length including standard and non-standard lengths. For example, the lamp may be made in a one foot length, a two foot length, a three foot length or other lengths including significantly longer lengths. Moreover, a single installation may use lamps of varying lengths.

Figure 17:
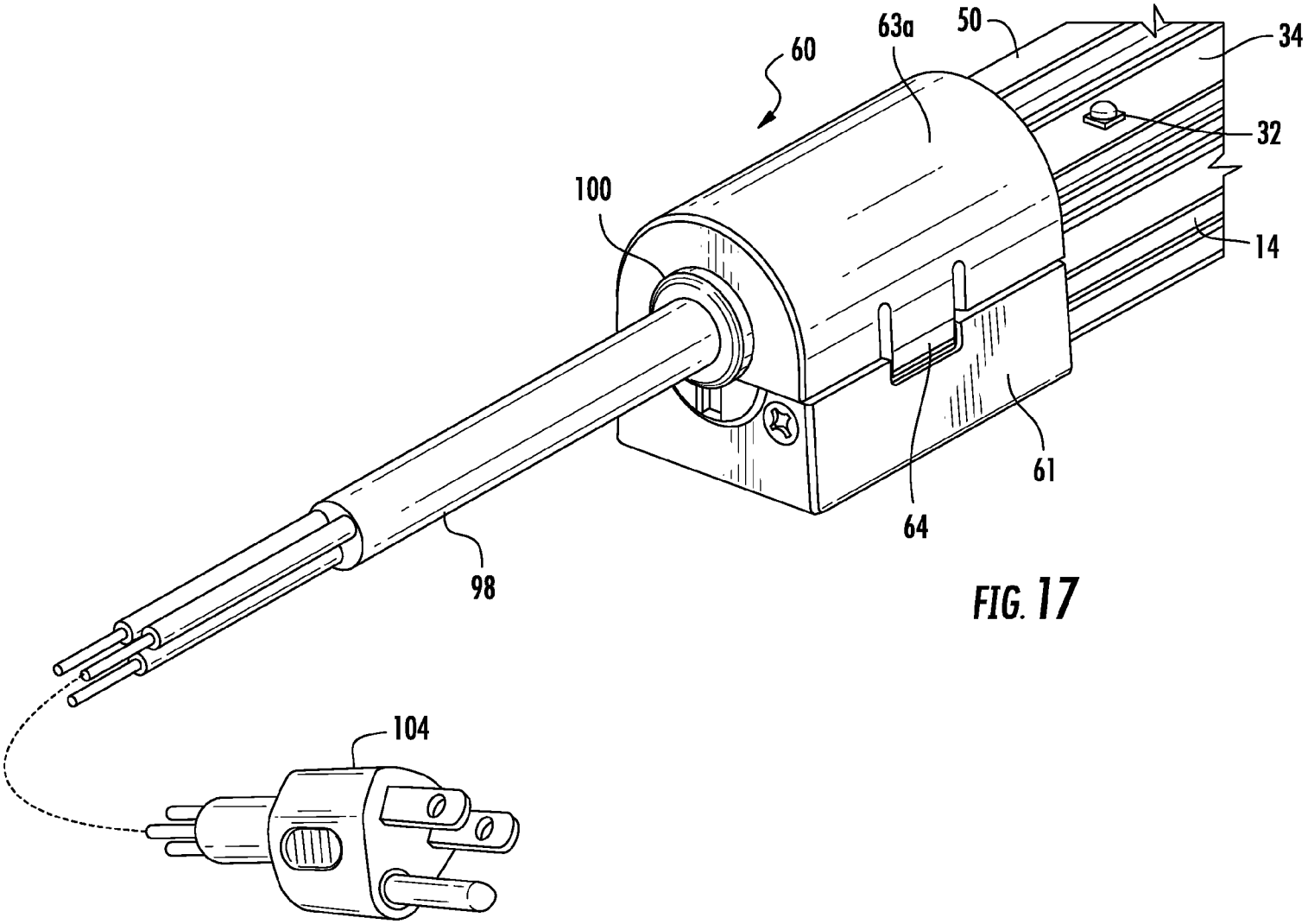
FIG. 17 is a partial perspective view showing an embodiment of an electrical connector used with the lamp of FIG. 1.
Figure 18:
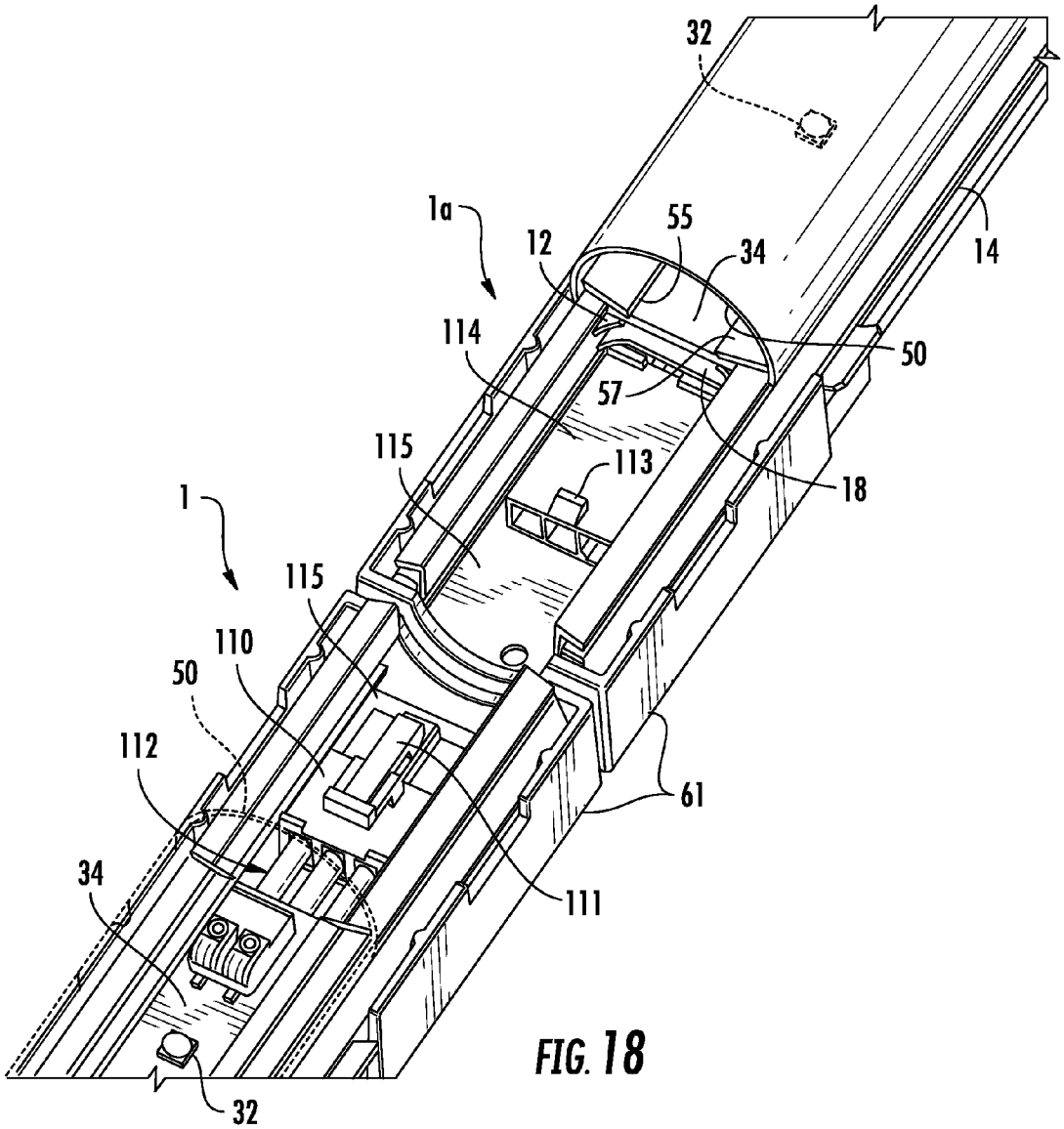
FIG. 18 is a perspective view of two lamps shown in a partially connected position.
Figure 23:
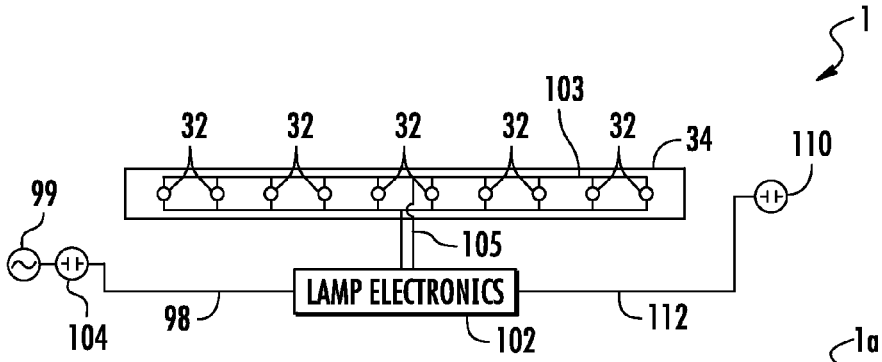
FIGS. 23-27 schematically illustrate embodiments of the electrical connections for the lamp.

In one embodiment, as shown in FIGS. 17 and 23 lamp 1 may comprise a power cable 98 that extends from the exterior of the lamp through aperture 96 in the end cap 60 and into the wire way 101 formed in base 10 between bottom wall 16 and cross member 18. The power cable 98 may contain wires for providing both sides of the current and a ground wire. The power cable 98 is connected to lamp electronics 102 that may be located in the wire way 101. The lamp electronics 102 are contained in the wire way 102 and may comprise a board or boards, such as a circuit board, on which the power supply and other electrical components are mounted. The power cable 98 is electrically coupled to the lamp electronics 102 for carrying both sides of the critical current to the lamp. The power cable 98 may terminate in a plug or other connector 104 that may be inserted into a mating outlet that is connected to a power source 99. Alternatively the connector 104 may comprise a hard wire connection to power source 99. The power cable 98 forms a part of the electrical path for powering the LEDs. The electrical path may also include the lamp electronics 102, conductors 105 from the lamp electronics 102 to the LED board 34 and conductors 103 on the LED board to the LEDs 32. In some embodiments, where plural lamps are connected to one another such that power is provided from one lamp to an additional lamp or lamps, one lamp may have the driver and the appropriate current is supplied to all of the LEDs in all of the Lamps from the lamp with the driver while in other embodiment each lamp may comprise a driver such that each lamp receives the same power from the power source.

Figure 24:
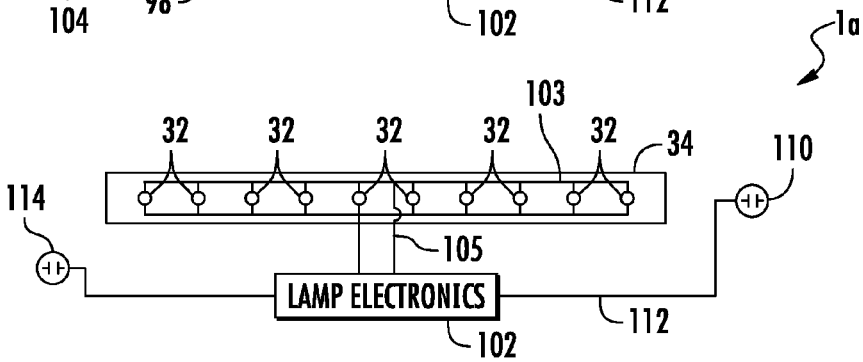
Figure 27:
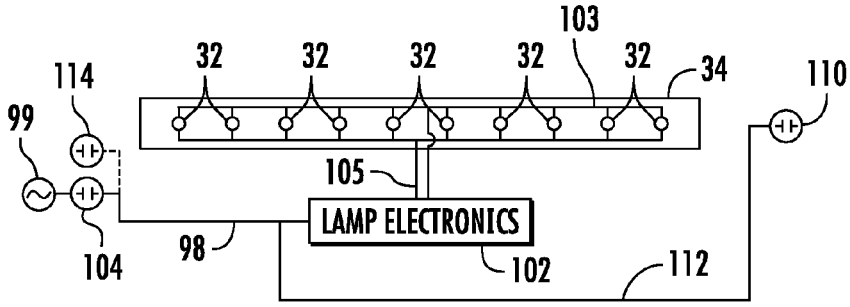

Referring to FIGS. 18-20 and 23, in some embodiments the electrical current from power cable 98 is also provided to an electrical connector 110 via wires 112. The electrical path may also include electrical connector 110 and wires 112. The electrical current may be provided through the lamp electronics 102 where the lamp electronics and wiring 112 are connected in series (shown in FIG. 23) or the current may be provided to connector 110 in parallel with the lamp electronics 102 where power cable 98 is electrically coupled to wires 112 (shown in FIG. 27). Connector 110 is located in compartment 115 in base 10 underneath the top section 63 of end cap 60 where it may be stored out of sight when not in use. Connector 110 may comprise one of a male or female electrical plug configured to mate with a connector 114 that comprises a corresponding female or male plug on a second lamp 1*a* to complete an electrical path between the plugs. The second connector 114 is connected to the lamp electronics 102 of the second lamp 1*a* by wiring such that electrical current provided from the first lamp may be used to power the second lamp via the coupling of electrical connectors 110, 114 (FIG. 24). Connector 110 may be provided with a releasable locking member 111 that engages mating locking member 113 on connector 114.

To connect lamp 1 in series with a second lamp 1*a*, the top section 63 of end cap 60 is removed on both lamps 1 and 1*a* to reveal connectors 110 and 114. The top sections 63 are removed by flexing locking members 64 to disengage the locking members from the base. The connector 110 is extended to the exterior of lamp 1 and is electrically coupled to connector 114 in compartment 115 of lamp 1*a*. Wires 112 are made of a sufficient length to allow the connector 110 to extend outside of the end cap 60. The top sections 63 are mounted on the bottom sections 61 of both lamps 1 and 1*a*. The top sections 63 are mounted by forcing the locking members 64 over angled camming surfaces 59 such that the locking members 64 deform and engage channels 56 and 58 on the base 10. The wiring 112 is extended through slots 94 such that the wiring extends between the lamps 1 and 1*a* and the connectors 110, 112 are located in the end cap of one of lamps 1 and 1*a*. The second lamp 1*a* is connected to the first lamp 1 such that current may be delivered from lamp 1 to lamp 1*a*. In this embodiment the lamps 1 and 1*a* are intended to be mounted in an end to end abutting relationship where the lamps are arranged in a linear path. The wires 112 are covered by the end caps because the walls 83 of the end caps 60 of the adjacent lamps 1 and 1*a* abut or are closely adjacent to one another. "Abut" as used herein means that the end caps are physically touching or are in very close proximity to one another such that the wires 112 extending between the lamps 1 and 1*a* are not exposed or accessible.

Figure 25:
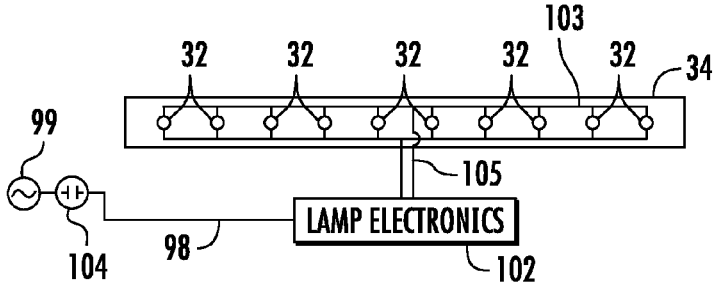
Figure 26:
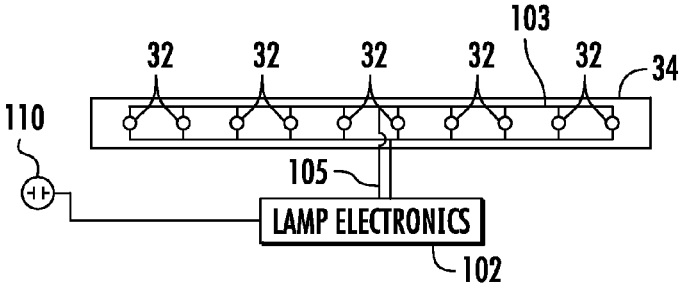

The second lamp 1*a* may be provided with a first connector 110 at its opposite end such that the second lamp 1*a* may be connected to a third lamp as described above such that current is carried from the first lamp to the second lamp and from the second lamp to a third lamp or additional lamps. This arrangement may be repeated for a plurality of lamps to create a modular, expandable linear lighting system. Different lamps may be provided with the different types of connectors as needed to complete the system. For example, one lamp may be provided with a first connector 104 and power cable 98 for connecting to a source of power 99 and a first connector 110 for connecting to additional lamps (FIG. 23). Intermediate lamps may comprise one of the first connector 110 and the second connector 114 (FIG. 24) such that these lamps may be connected in series with one another. A third configuration of the lamp may be provided only with a first connector 110 (FIG. 26) for connecting to one lamp such that this lamp functions as the end lamp in a series of interconnected lamps. In another configuration one lamp may be provided with a first connector 104 and power cable 98 (FIG. 25) where this lamp connects to a source of power but is not intended to be connected to another lamp. In some embodiments all of the lamps may include at least two connectors. The various mechanisms for making the electrical connections to and from the lamps may be used in various combinations.

Figure 19:
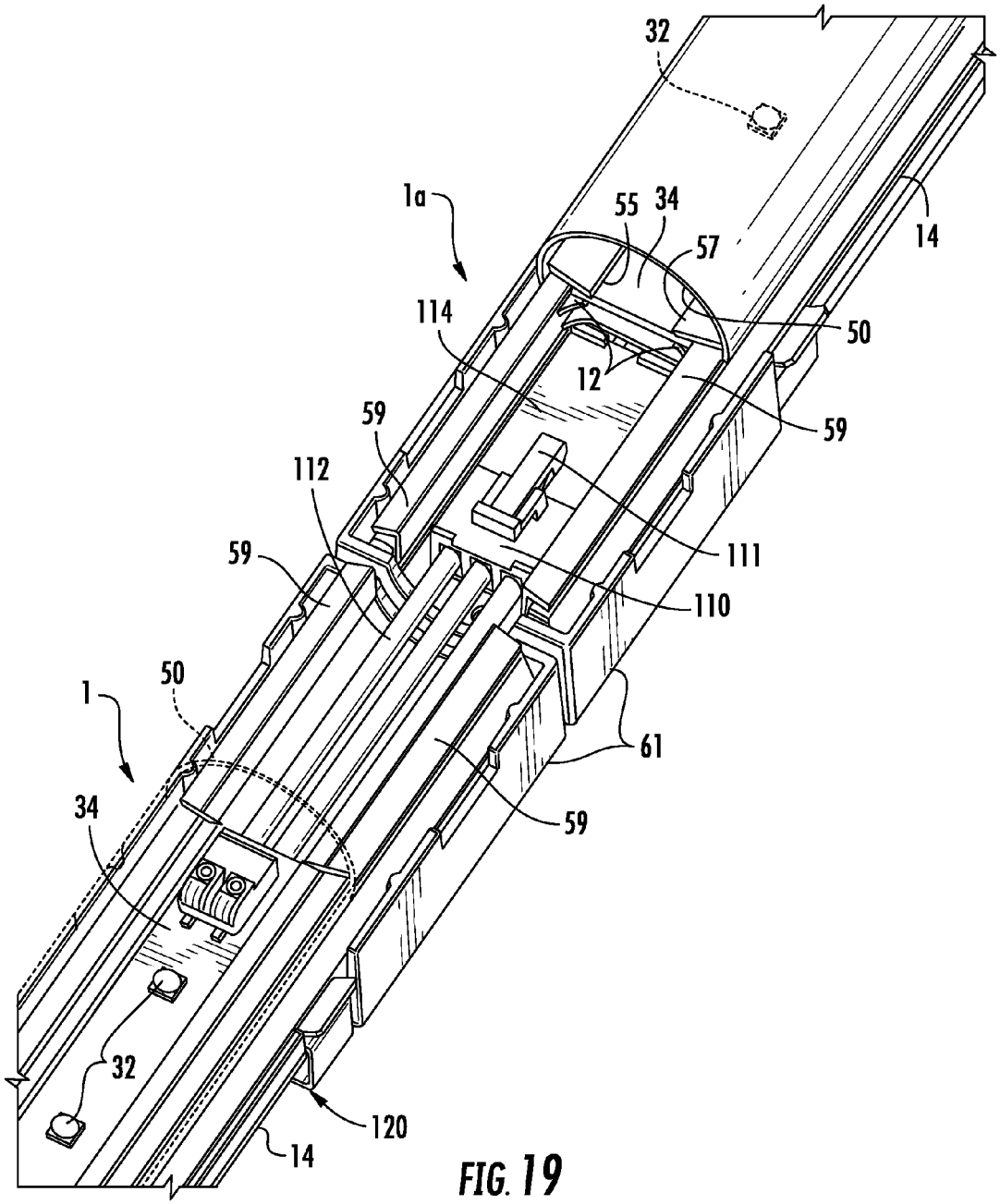
FIG. 19 is a perspective view of two lamps shown in an electrically connected position.
Figure 20:
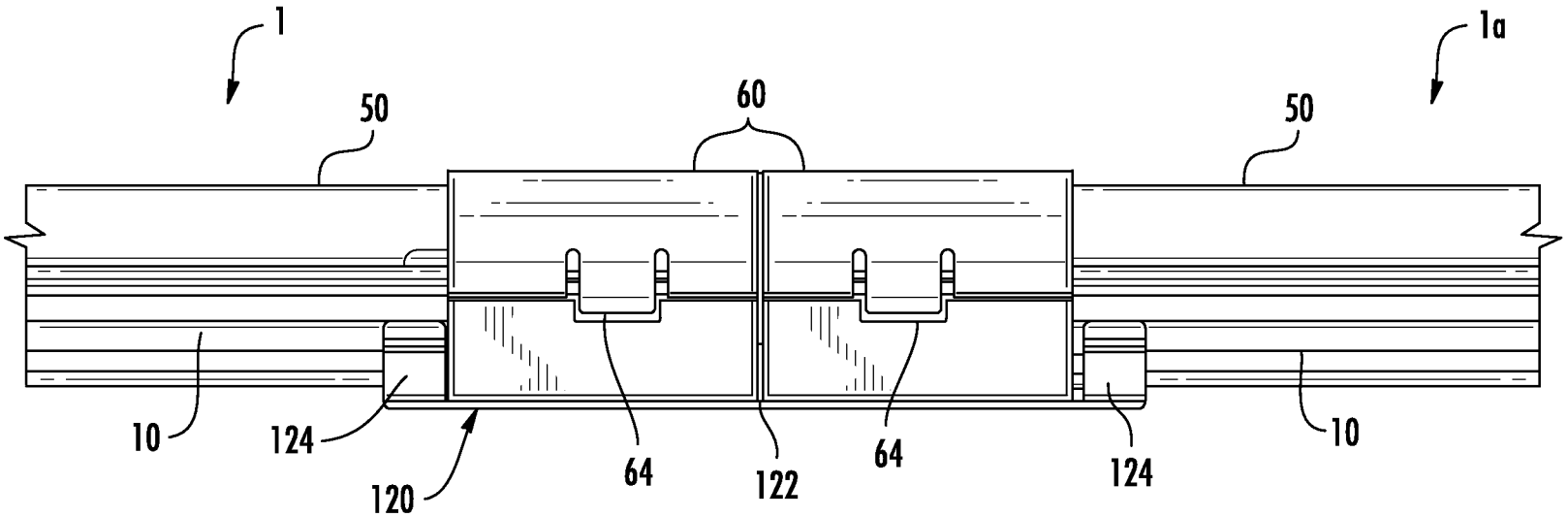
FIG. 20 is a side view showing two LED lamps connected together.
Figure 21:
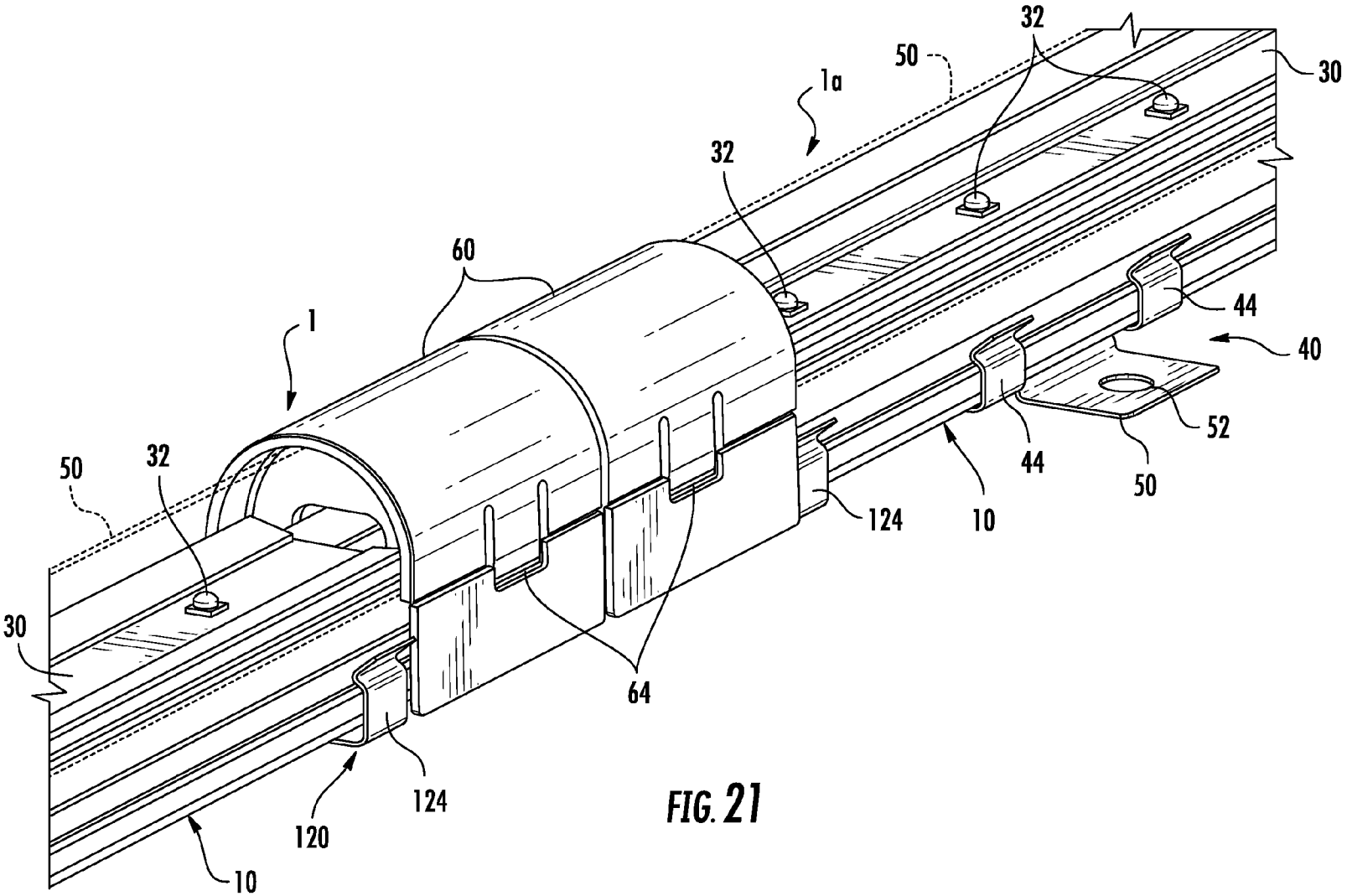
FIG. 21 is a perspective view showing two LED lamps connected together.

With use of the first connector 110 and the second connector 114, as described above, the lamps are intended to be connected in a relatively straight line in an abutting relationship where the end of one lamp physically contacts or is closely adjacent to the end of the adjacent lamp. In some embodiments a bracket 120 may be used to mechanically connect adjacent lamps together. Referring to FIGS. 19-21 the bracket 120 may have a construction similar to the mounting brackets 40 where a base plate 122 is dimensioned to span two lamps 1, 1*a*. In one embodiment the base plate 122 is dimensioned to extend across and beyond the two abutting end caps. A pair of tabs 124 is provided on each side of the base plate 122, the tabs 124 being positioned to engage the grooves 20 in the base 10, as previously described with respect to tabs 44, just beyond the internal edges of the end caps 60. The two end caps 60 are trapped between the tabs 124 such that the lamps 1, 1*a* may not be separated from one another without removing the bracket 120.

Figure 22:
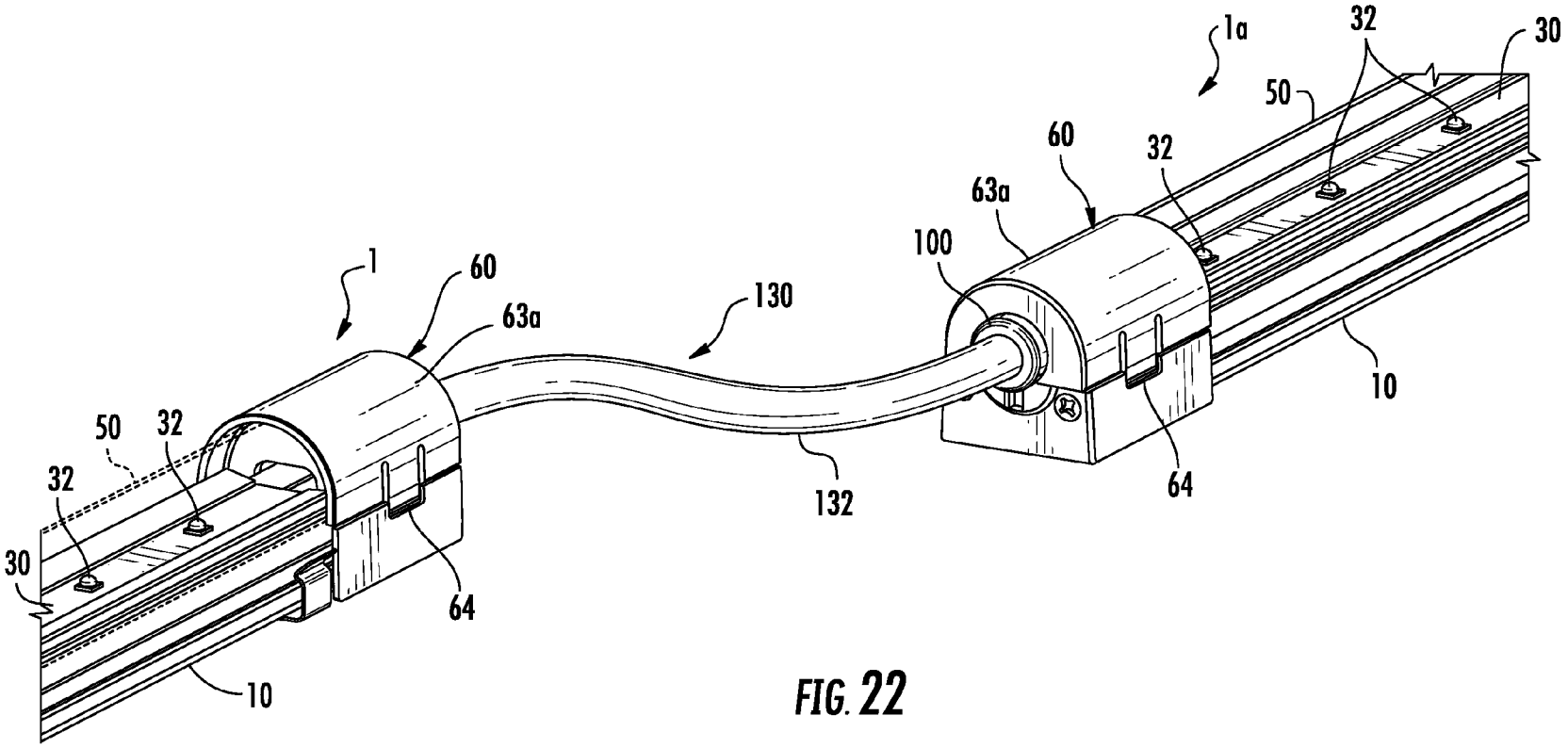
FIG. 22 is a perspective view showing two LED lamps connected together in a second embodiment.

In some embodiments it may be desirable to connect a plurality of lamps 1, 1*a* together in series as previously described while allowing the lamps to be oriented relative to one another in other than a straight line. Referring to FIG. 22 the first connector 110 may be mounted at the end of a flexible electrical connector 130 having a sufficient length such that the connected lamps 1, 1*a* may be spaced from one another such that the lamps are not abutting. The lamps 1 and 1*a* may be oriented relative to one another in other than a straight line by flexing connector 130. The flexible connector 130 may comprise wires 112 having a connector 110, 114 at the end thereof where the wires extend a distance from one of the lamps 1, 1*a* that allow the wires to flex to allow the lamps 1, 1*a* to be oriented at any angle relative to one another. It may be desirable or required to encase the wires 112 such as by using an electrically insulated cable 132 because the electrical wires 112 would otherwise be exposed to the ambient environment. Other insulating devices such as conduit, flexible metal cables or the like may also be used to encase the wiring. As used herein "cable" means a flexible electrical connection that may be exposed to the ambient environment and that allows two interconnected lamps to be oriented at angles relative to one another by flexing the cable. Because the cable 132 may be too large to fit through the slots 94 formed in the end caps 60, a second end cap top section 63*a* may be used that has an aperture 96 large enough to receive the cable. A strain relief grommet 100 may be used to line the aperture. Use of the flexible connection between adjacent lamps 1, 1*a* allows the lamps to be disposed relative to one another in other than a straight line.

To assemble the lamp of the invention, an LED board 34 is populated with LEDs 32. The LED board 34 is located on the flanges 12 of the base 10 such that the board 34 is supported by the base 10. In addition to supporting the board 34 the base 10 may also function as a heat sink to dissipate heat generated by the LEDs 32 to the ambient environment. The lamp electronics 102 are located in wireway 101 and the electrical path 105 from the board 34 to the power supply 102 is completed. The appropriate electrical connectors 104, 110, 114 are connected to the electrical path using wires 114 and/or power cable 98. The lens 50 is mounted to the base 10 by inserting the flanges 52, 54 of the lens into the mating C-channels 56, 58 on the base 10. The flanges may be slid into the C-channels or the lens may be deformed and snap-fit into the C-channels. The flanges 55, 57 of the lens 50 are engaged with the board 34 to hold the LED board 34 against the flanges 12. The first and second end caps 60 may be mounted to the base 10 with the electrical connectors contained in the end caps as previously described. Plural lamps may be connected together to create a lighting system during installation of the lamps on site.

Although specific embodiments have been shown and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A lighting system comprising:

a lamp comprising:

an enclosure being at least partially optically transmissive;

at least one LED in the enclosure operable to emit light through the enclosure when energized through an electrical path;

a first electrical connector for connecting the electrical path to a power source and a second electrical connector configured to connect the electrical path to a second lamp wherein the second electrical connector may be moved between a first position where the second electrical connector is stored in the enclosure and a second position where the second electrical connector is outside of the enclosure for connection to the second lamp.

2. The lighting system of claim 1 wherein the enclosure comprises a base made of a thermally conductive material, the base being thermally coupled to the at least one LED.

3. The lighting system of claim 1 wherein the enclosure comprises a base, and a plurality of LEDs extending for substantially the length of the base.

4. The lighting system of claim 1 wherein the enclosure comprises an optically transmissive lens.

5. The lighting system of claim 4 wherein the lens is connected to a base comprising a first channel and a second channel for receiving a first edge and a second edge of the lens, respectively.

6. The lighting system of claim 1 wherein the at least one LED is mounted on a LED board that provides physical support for the at least one LED and forms part of the electrical path.

7. The lighting system of claim 6 wherein the LED board comprises a FR4 board.

8. The lighting system of claim 6 wherein the enclosure comprises a base, the LED board being mounted on the base.

9. The lighting system of claim 1 wherein the first electrical connector comprises a power cord.

10. The lighting system of claim 1 wherein the first electrical connector is configured to connect to the second lamp.

11. The lighting system of claim 10 wherein the first electrical connector and the second electrical connector comprise one of a male plug and a female plug.

12. The lighting system of claim 1 wherein the second electrical connector comprises a cable that extends from the lamp and terminates in one of a male plug and a female plug.

13. The lighting system of claim 1 wherein the second lamp comprises an enclosure being at least partially optically transmissive; at least one LED in the enclosure operable to emit light through the enclosure when energized through an electrical path; and a third connector configured to connect to the second connector.

14. The lighting system of claim 13 wherein the third connector comprises one of a male and female plug connected to the second lamp by a flexible cable.

15. The lighting system of claim 13 wherein the lamp abuts the second lamp when the third connector is connected to the second connector and the second connector is located in the enclosure of the second lamp.

16. The lighting system of claim 15 further comprising a bracket for connecting the lamp to the second lamp.

17. The lighting system of claim 13 wherein the third connector and the second connector are located inside one of the lamp and the second lamp.

18. The lighting system of claim 17 wherein the third connector and the second connector are located inside of an end cap of one of the lamp and the second lamp, a section of the end cap being removable to provide access to the third connector and the second connector.

19. The lighting system of claim 1 wherein the lamp comprises a base, a bracket releasably connected to the base, the bracket comprising a mounting mechanism for mounting the bracket to a support surface.

20. The lighting system of claim 1 wherein the enclosure comprises an optically transmissive lens and a base, the at least one LED being mounted on a LED board and a portion of the lens holding the LED board against the base.

* * * * *